US012392585B2

(12) United States Patent
Lee

(10) Patent No.: US 12,392,585 B2
(45) Date of Patent: Aug. 19, 2025

(54) DART GAME DEVICE

(71) Applicant: Phoenixdarts Co., Ltd., Seoul (KR)

(72) Inventor: Seung Yoon Lee, Seoul (KR)

(73) Assignee: PHOENIXDARTS CO., LTD., Seoul (KR)

( * ) Notice: Subject to any disclaimer, the term of this patent is extended or adjusted under 35 U.S.C. 154(b) by 417 days.

(21) Appl. No.: 17/769,842

(22) PCT Filed: Aug. 10, 2020

(86) PCT No.: PCT/KR2020/010543
§ 371 (c)(1),
(2) Date: Apr. 18, 2022

(87) PCT Pub. No.: WO2021/075685
PCT Pub. Date: Apr. 22, 2021

(65) Prior Publication Data

US 2022/0381539 A1 Dec. 1, 2022

(30) Foreign Application Priority Data

Oct. 18, 2019 (KR) ..... 10-2019-0129955

(51) Int. Cl.

| | |
|---|---|
| ***F41J 5/04*** | (2006.01) |
| ***F41J 3/00*** | (2006.01) |
| ***F41J 5/056*** | (2006.01) |
| *F41J 5/10* | (2006.01) |
| *F41J 5/14* | (2006.01) |

(52) U.S. Cl.
CPC ..... *F41J 3/0019* (2013.01); *F41J 5/056* (2013.01); *F41J 5/10* (2013.01); *F41J 5/14* (2013.01)

(58) Field of Classification Search
None
See application file for complete search history.

(56) References Cited

U.S. PATENT DOCUMENTS

| | | | | |
|---|---|---|---|---|
| 4,241,777 | A | 12/1980 | Wenger et al. | |
| 4,881,744 | A | 11/1989 | Hansen | |
| 5,004,247 | A | 4/1991 | Menke | |
| 5,211,405 | A | 5/1993 | Shelton et al. | |
| 5,275,418 | A * | 1/1994 | Yiu | F41J 5/04 273/403 |

(Continued)

FOREIGN PATENT DOCUMENTS

| | | | |
|---|---|---|---|
| CN | 102107084 | A | 6/2011 |
| CN | 105771283 | A | 7/2016 |

(Continued)

OTHER PUBLICATIONS

New Zealand Intellectual Property Office, Examination Report, Nov. 22, 2023.

(Continued)

*Primary Examiner* — Sunit Pandya
(74) *Attorney, Agent, or Firm* — Umberg Zipser LLP

(57) ABSTRACT

Provided is a dart game apparatus including: a body part forming an external appearance of a dart game apparatus; a target fixation plate provided in one area of a front surface of the body part; a dart target unit seated on the front surface of the target fixation plate; and a target cover unit formed to cover at least a part of the dart target unit, and fixed and coupled to the target fixation plate.

12 Claims, 10 Drawing Sheets

(56) References Cited

U.S. PATENT DOCUMENTS

| | | | | |
|---|---|---|---|---|
| 6,089,571 | A * | 7/2000 | Cho | F41J 5/048 273/374 |
| 6,302,809 | B1 * | 10/2001 | Yiu | F41J 3/0066 473/376 |
| 6,715,760 | B2 * | 4/2004 | Miller | A63B 24/0021 273/371 |
| 7,624,988 | B2 * | 12/2009 | Shao | F41J 5/04 273/371 |
| 10,762,800 | B2 | 9/2020 | Hong | |
| 2012/0200042 | A1 | 8/2012 | Kelly et al. | |
| 2017/0189810 | A1 | 7/2017 | Hong | |
| 2017/0326444 | A1 | 11/2017 | Hong | |
| 2018/0238662 | A1 | 8/2018 | Oh et al. | |

FOREIGN PATENT DOCUMENTS

| | | | |
|---|---|---|---|
| CN | 106999763 | A | 8/2017 |
| CN | 208726704 | U | 4/2019 |
| GB | 508153 | A | 6/1939 |
| JP | 5558749 | B2 | 7/2014 |
| KR | 19990034812 | U | 9/1999 |
| KR | 2019990034812 | U | 9/1999 |
| KR | 1020050017344 | A | 2/2005 |
| KR | 1020100012522 | A | 2/2010 |
| KR | 101032367 | B1 | 5/2011 |
| KR | 101815119 | B1 | 1/2018 |
| KR | 101897116 | B1 | 9/2018 |
| KR | 1020190079009 | A | 7/2019 |
| TW | 201735974 | A | 10/2017 |
| TW | 201916914 | A | 5/2019 |

OTHER PUBLICATIONS

Office Action for Japanese Patent Application No. 2022-522872 dated May 9, 2023; 4 pgs.

Dershang, Premium Door Type Electronic Dart Machine (Xiaodou Sprout Dart Net #F01), available at https://www.ruten.com.tw/item/show?21109192372490.

PCT International Search Report and Written Opinion; International Application No. PCT/KR2020/010543; International Filing Date Aug. 10, 2020; 7 pages.

Office Action for Chinese Patent Application No. 202080073076 dated Jan. 24, 2025; 6 pgs.

Office Action for European Patent Application No. 20876095.9 dated Sep. 29, 2023; 8 pgs.

Office Action for Singapore Patent Application No. 11202203939P dated Dec. 6, 2023; 8 pgs.

Office Action for Chinese Patent Application No. 202080073076 dated Jun. 10, 2025; 8 pgs.

* cited by examiner

DART GAME DEVICE

CROSS-REFERENCE TO RELATED APPLICATIONS

This application claims priority to and the benefit of Korean Patent Application No. 10-2019-0129955 filed in the Korean Intellectual Property Office on Oct. 18, 2019, the entire contents of which are incorporated herein by reference.

TECHNICAL FIELD

The present disclosure relates to a dart game apparatus.

BACKGROUND ART

In general, a dart refers to a 'small arrow' and is a game that makes marks by throwing an arrow-shaped dart to a centrifugal target marked with figures. The dart game has an advantage in that anybody can enjoy the dart game anytime if there are an arrow-headed dart and a dart game apparatus. In recent years, as various game methods have been developed and scoring methods have been organized, the dart game has been developed as worldwide leisure, and therefore, men and women of all ages have conveniently enjoyed the dart game.

As the demand for dart games is increasing, there are often places where a dart game apparatus is provided in commercial facilities such as a café, a restaurant, a bar, etc., and dart game fields that have a plenty of dart game apparatuses and provide entertainment to persons are also generated.

However, unlike the days when a player throws a pointed dart pin with a needle to a dart target made of wood or cork to simply calculate a score, dart game apparatuses which are electrically operated form a mainstream for a safety reason or in order to add various entertainment factors, nowadays.

The electronic dart game apparatus primarily has a piezoelectric element inside the dart target. In addition, in the dart game apparatus, a score of a dart game is counted by an electrical signal generated when a dart pin thrown by a user reaches the dart target and a change occurs in the piezoelectric element.

In order for the dart pin thrown by the user to be stuck in a groove which may be provided in the dart target, a sharp shaped part such as an arrowhead called a tip is assembled to a front surface as the dart pin.

However, the dart tip that cannot but have a sharp structure is significantly low in durability and the dart tip is often broken while being stuck in the dart target. In this case, a user who operates the dart game apparatus may have to inconveniently call a visit repair engineer in order to repair the dart target. Further, the dart game apparatus may not be used until the dart target is repaired. The situations cannot but be a burden to a business owner who conducts business by using the dart game apparatus.

The dart game apparatus may have a foul line so as to check whether the dart pin thrown from the user is fouled on an outline of the dart target. However, the foul line may not be a component particularly required in an official game. As a result, some users may find a dart game apparatus having another component installed therein instead of the foul line. Manufacturing apparatuses of various specifications for some users may be a burden to a company which manufactures the dart game apparatus.

Accordingly, there is a demand for a dart target and components which may be replaced according to whether a problem occurring in the dart target or according to a taste of the user who uses the dart game apparatus.

SUMMARY OF THE INVENTION

The present disclosure is contrived to correspond to the background art, and has been made in an effort to provide a method for being capable of providing a dart game apparatus in which it is easy to replace a dart target unit and a target cover unit.

However, technical objects of the present disclosure are not restricted to the technical object mentioned as above. Other unmentioned technical objects will be apparently appreciated by those skilled in the art by referencing to the following description.

An exemplary embodiment of the present disclosure provides a dart game apparatus. The dart game apparatus may include: a body part forming an external appearance of a dart game apparatus; a target fixation plate provided in one area of a front surface of the body part; a dart target unit seated on the front surface of the target fixation plate; and a target cover unit formed to cover at least a part of the dart target unit, and fixed and coupled to the target fixation plate.

The dart target unit may include a seating unit seated on the front surface of the target fixation plate and having a first diameter, and a dart plate formed to be projected toward the front surface of the seating unit and having a second diameter smaller than the first diameter.

The dart game apparatus may further include at least one guide pin formed to be projected toward the front surface of the body part and guiding locations at which the target fixation plate and the dart target unit are seated on the front surface of the body part, and the target fixation plate may include at least one first guide hole provided at a location corresponding to the at least one guide pin, and the seating unit may include at least one second guide hole provided at the location corresponding to the at least one guide pin.

When the target fixation plate and the seating unit are seated on the front surface of the body part, the at least one guide pin may penetrate at least one first guide hole and the at least one second guide hole.

The body part may include at least one first guide groove into which the at least one guide pin is inserted so that the at least one guide pin is coupled to the body part.

The target cover unit may include a front surface unit having an opening unit for exposing the dart plate to outside and covering at least a part of the dart target unit, and a lateral surface unit having at least one fastening hole into which at least one bolt is inserted so that the target cover unit is coupled to the target fixation plate.

The target fixation plate may include at least one suspension protrusion unit for fixing the target cover unit to an outer peripheral surface, the target cover unit may include a projection unit formed on a rear surface of the front surface unit to be projected toward the rear surface of the front surface unit, and the projection unit may include at least one dented unit formed along an inner peripheral surface of the lateral surface unit and dented toward the front surface unit, and at least one receiving groove provided inside in at least one area of the projection unit exposed through the at least one dented unit.

The at least one suspension protrusion unit may include a suspension member formed so that at least a part is inserted into the at least one receiving groove, and a connection member formed to extend toward the front surface of the target fixation plate, and connecting the suspension member and the target fixation plate.

When the target cover unit is seated on the target fixation plate, the suspension member may be inserted into the at least one dented unit, and when the target cover unit rotates in a first direction, the suspension member may be inserted into the at least one receiving groove.

The target fixation plate may include an opening unit provided in at least a part thereof, and the body part may include at least one elastic member provided to contact the rear surface of the dart target unit through the opening unit.

The dart target unit may be in close contact with the target cover unit by restoration force of the at least one elastic member.

The target cover unit may include a projected display unit formed to be projected on an outer peripheral surface, and the projected display unit may be disposed at a predetermined location when a part of the suspension protrusion unit is inserted into the at least one receiving groove.

The target cover unit may include at least one vibration sensor unit disposed on the front surface of the front surface unit, and at least one first power terminal provided on the rear surface of the front surface unit and delivering power to the at least one vibration sensor unit, and the seating unit may include at least one second power terminal delivering power to the vibration sensor unit by being in contact with the at least one first power terminal.

When a part of the suspension protrusion unit is inserted into the at least one receiving groove, the at least one first power terminal and the at least one second power terminal may contact each other.

Technical solving means which can be obtained in the present disclosure are not limited to the aforementioned solving means and other unmentioned solving means will be clearly understood by those skilled in the art from the following description.

According to an exemplary embodiment of the present disclosure, a dart game apparatus can be provided in which it is easy to replace a dart target unit and a target cover unit.

Effects which can be obtained in the present disclosure are not limited to the aforementioned effects and other unmentioned effects will be clearly understood by those skilled in the art from the following description.

BRIEF DESCRIPTION OF THE DRAWINGS

Various aspects are now described with reference to the drawings and like reference numerals are generally used to designate like elements. In the following exemplary embodiments, for the purpose of description, multiple specific detailed matters are presented to provide general understanding of one or more aspects. However, it will be apparent that the aspect(s) can be executed without the specific detailed matters. In other examples, known structures and apparatuses are illustrated in a block diagram form in order to facilitate description of the one or more aspects.

DETAILED DESCRIPTION

Figure 1:
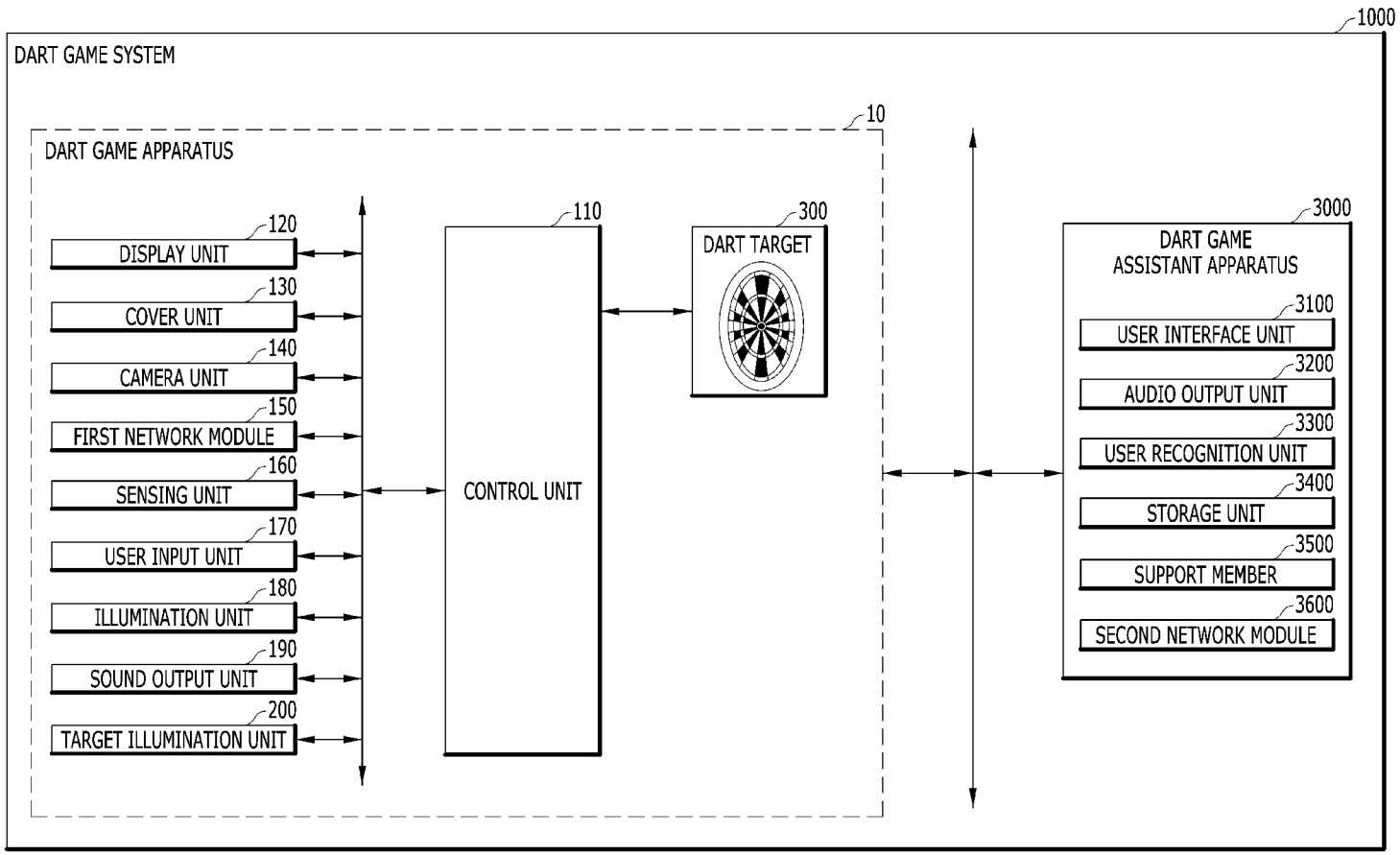
FIG. 1 is a block diagram for describing components of a dart game system according to some exemplary embodiments of the present disclosure.

Various exemplary embodiments and/or various aspects will be disclosed with reference to the drawings. In the following descriptions, for explanation, multiple specific details are disclosed in order to provide overall understandings of one or more aspects. However, it will also be appreciated by those skilled in the art that this aspect(s) may be practiced without these specific details. The following descriptions and the accompanying drawings are provided for disclosing specific exemplary aspects of the one or more aspects in detail. However, these aspects are exemplary. Thus, some of the various methods in the principles of the various aspects may be used, and the descriptions are intended to include all such aspects and their equivalents. Specifically, "an exemplary embodiment", "an example", "an aspect", and the like used in this specification may not be construed as any aspect or design described being better or advantageous than other aspects or designs.

Hereinafter, the same or similar constituent elements are assigned with the same reference numerals regardless of reference numerals, and the repetitive description thereof will be omitted. In addition, in the description of the exemplary embodiment disclosed in the present specification, the specific descriptions of publicly known related technologies will be omitted when it is determined that the specific descriptions may obscure the subject matter of the exemplary embodiment disclosed in the present specification. In addition, the accompanying drawings are provided only to allow those skilled in the art to easily understand the exemplary embodiments disclosed in the present specification, and the technical spirit disclosed in the present specification is not limited by the accompanying drawings.

Terms "first", "second", and the like may be used to describe various elements and components, but the elements and components are of course not limited by these terms. These terms are merely used to distinguish one element or component from another element or component. Therefore, the first element or component mentioned hereinafter may of course be the second element or component within the technical spirit of the present disclosure.

Unless otherwise defined, all terms (including technical and scientific terms) used in the present specification may be used as the meaning which may be commonly understood by the person with ordinary skill in the art, to which the present disclosure belongs. In addition, terms defined in a generally used dictionary shall not be construed in ideal or excessively formal meanings unless they are clearly and specially defined in the present specification.

The term of "or" is intended to mean not an exclusive "or" but an inclusive "or". That is, unless specified or clear in context, "X uses A or B" is intended to mean one of the natural implicit substitutions. That is, "X uses A or B" can be applied to any of the cases where X uses A, X uses B, or X uses both A and B. Moreover, it is to be understood that the term of "and/or" used in this specification refers to and includes all possible combinations of one or more of the listed related items.

It is to be understood that the terms of "comprises" and/or "comprising" mean that the feature and/or a component is provided, but one or more other features, other components and/or the presence or addition of groups thereof are not excluded. In addition, unless specified or clear in the context of indicating a singular form, the singular in this specification and claims should generally be construed to mean "one or more".

The terms "information" and "data" used in the present specification may sometimes be interchangeably used.

The suffixes "module" and "unit" used to describe some constituent elements in the following description are used together or interchangeably in order to facilitate the description, but the suffixes themselves do not have distinguishable meanings or functions.

When one constituent element is described as being "connected" or "coupled" to another constituent element, it should be understood that one constituent element can be connected or coupled directly to another constituent element, and an intervening constituent element can also be present between the constituent elements. When one constituent element is described as being "connected directly to" or "coupled directly to" another constituent element, it should be understood that no intervening constituent element is present between the constituent elements.

When an element or layer is referred to as being "on" another element or layer, it can be directly on the other element or layer or intervening elements or layers may be present. In contrast, when an element is referred to as being "directly on" another element or layer, there are no intervening elements or layers present.

Spatially relative terms, such as "below," "beneath," "lower," "above," "upper," and the like, may be used herein for ease of description to describe one constituent element or a correlation between one constituent element and other constituent elements, as illustrated in the drawings. It should be understood that the spatially relative terms encompass different orientations of the elements in use or operation in addition to the orientation depicted in the drawings.

For example, if the constituent element in the drawings is turned over, the constituent element described as "below" or "beneath" the other constituent element may then be oriented "above" the other constituent element. Thus, the exemplary term "below" can encompass both orientations of above and below. The constituent elements may be oriented in different directions, and the spatially relative terms used herein may be interpreted in accordance with the orientations.

Objects and effects of the present disclosure and technical constituent elements for achieving the objects and effects will be clear with reference to the exemplary embodiments described in detail below together with the accompanying drawings. In addition, in the description of the present disclosure, the specific descriptions of publicly known functions or configurations will be omitted when it is determined that the specific descriptions may unnecessarily obscure the subject matter of the present disclosure. In addition, the terms used herein are defined considering the functions in the present disclosure and may vary depending on the intention or usual practice of a user or an operator.

The scope of the claims for the method in the claims of the present disclosure arises from the functions and features described in each step and is not affected by the order in which each step in the claims disclosed if a sequence relationship of the disclosure order in respective steps constituting the method is not specified. For example, in the claims set forth in the method including steps A and B, the scope of rights is not limited to the fact that step A precedes step B, even if step A is described before step B.

However, the present disclosure is not limited to the exemplary embodiments disclosed herein but will be implemented in various forms. The exemplary embodiments of the present disclosure are provided so that the present disclosure is completely disclosed, and a person with ordinary skill in the art can fully understand the scope of the present disclosure. The present disclosure will be defined only by the scope of the appended claims. Therefore, the definition of the terms should be made based on the entire contents of the technology of the present specification.

A dart game apparatus 10 according to the present disclosure may have an electronic dart target unit capable of checking a location of a dart pin thrown by a user according to an electrical signal. Further, the dart target unit may be fixed to the dart game apparatus 10 and a target cover unit capable of checking the dart pin thrown from the user is fouled may be provided to cover at least a part of the dart target unit. In this case, the dart target unit may also be frequently replaced due to a reason such as breakage, etc. Further, the target cover unit may also be occasionally replaced due to a reason such as a taste of the user, etc.

To this end, the present disclosure discloses the dart target unit and the target cover unit capable of replacing the dart target unit. Hereinafter, the dart game apparatus 10 including a dart target and a dart game system 1000 according to the present disclosure will be described through FIGS. 1 to 10.

FIG. 1 is a block diagram for describing components of a dart game system according to some exemplary embodiments of the present disclosure.

According to some exemplary embodiments of the present disclosure, a dart game system 1000 may include a dart game apparatus 10 and a dart game assistant apparatus 3000. However, components described above are not required in implementing the dart game system 1000 and the dart game system 1000 may thus have components more or less than components listed above.

The dart game apparatus 10 may include a control unit 110, a display unit 120, a cover unit 130, a camera unit 140, a first network module 150, a sensing unit 160, a user input unit 170, an illumination unit 180, a sound output unit 190, a target illumination unit 200, and a dart target 300. However, the present disclosure is not limited thereto.

The control unit 110 generally controls all motions of the dart game apparatus 10. The control unit 110 processes a signal, data, information, and the like input or output through the components mentioned above or drives the application program stored in a memory (not illustrated) to provide or process information or a function appropriate for the user.

For example, the control unit 110 may aggregate a score input through the dart game play for each game participant. In addition, the control unit 110 may share an aggregated result with another dart game apparatus through a network.

The display unit 120 may be formed in a first area other than an area in which the dart target 300 is provided on a front surface of the dart game apparatus 10. Here, the front surface of the dart game apparatus 10 may be a surface visually exposed when the user views the dart game apparatus 10 beyond a throw-line. In addition, the first area may be an entire area other than a second area in which the dart target is positioned on the front surface of the dart game apparatus 10, and may be an area other than the second area and a periphery area of the dart game apparatus 10 on the front surface of the dart game apparatus 10. However, the present disclosure is not limited thereto.

By constituting the first area of the front surface of the dart game apparatus 10 by the display unit 120, it is possible to express a visual effect that is differentiated from the dart game apparatus in the related art. However, the present disclosure is not limited thereto.

Specifically, due to characteristics of the dart game, primary plays on the game may be conducted primarily on the dart target 300. In addition, in the dart target 300 and the first area positioned around the dart target 300, a visual concentration of the player is relatively high. That is, the first area may be an area in which the visual concentration of the user is high. Accordingly, the dart game apparatus 10 according to the present disclosure outputs various visual effects to the first area to enhance satisfaction or immersion of the user. Hereinafter, the first area will be described below through FIGS. 2 to 3.

The display unit 120 may include at least one of a liquid crystal display (LCD), a thin film transistor-liquid crystal display (TFT LCD), an organic light-emitting diode (OLED), a flexible display, a 3D display, and an electronic ink (e-ink) display. However, the present disclosure is not limited thereto.

The cover unit 130 may be provided adjacent to the display unit 120 on the front surface of the display unit 120 to protect the display unit 120. For example, the cover unit 130 may be positioned between a throw-line on which a player who throws a dart pin and the display unit 120. In this case, the cover unit 130 is positioned adjacent to the display unit 120 on the front surface of the display unit 120 to reduce a risk of damage to the display unit 120. As another example, the cover unit 130 may be provided in contact with the display unit 120. However, the present disclosure is not limited thereto.

In the present disclosure, a dart target unit 300 may be seated on a cover unit 130. For example, the dart target unit 300 may be coupled to a front surface of the cover unit 130 through a fixation member provided on the front surface of the cover unit 130, etc. Hereinafter, a method in which the dart target unit 300 is coupled to the front surface of the cover unit 130 will be described below through FIGS. 4 to 10.

Meanwhile, at least a part of the cover unit 130 may have optical transmittance. For example, a part of the cover unit 130 may be transparent, the other part may be translucent, and another part may be opaque. However, the present disclosure is not limited thereto.

The camera unit 140 may include at least one camera. An image frame processed by the camera unit 140 may be stored in the memory or transmitted to the outside through the first network module 150. Two or more camera units 140 may be provided according to a use environment.

Figure 2:
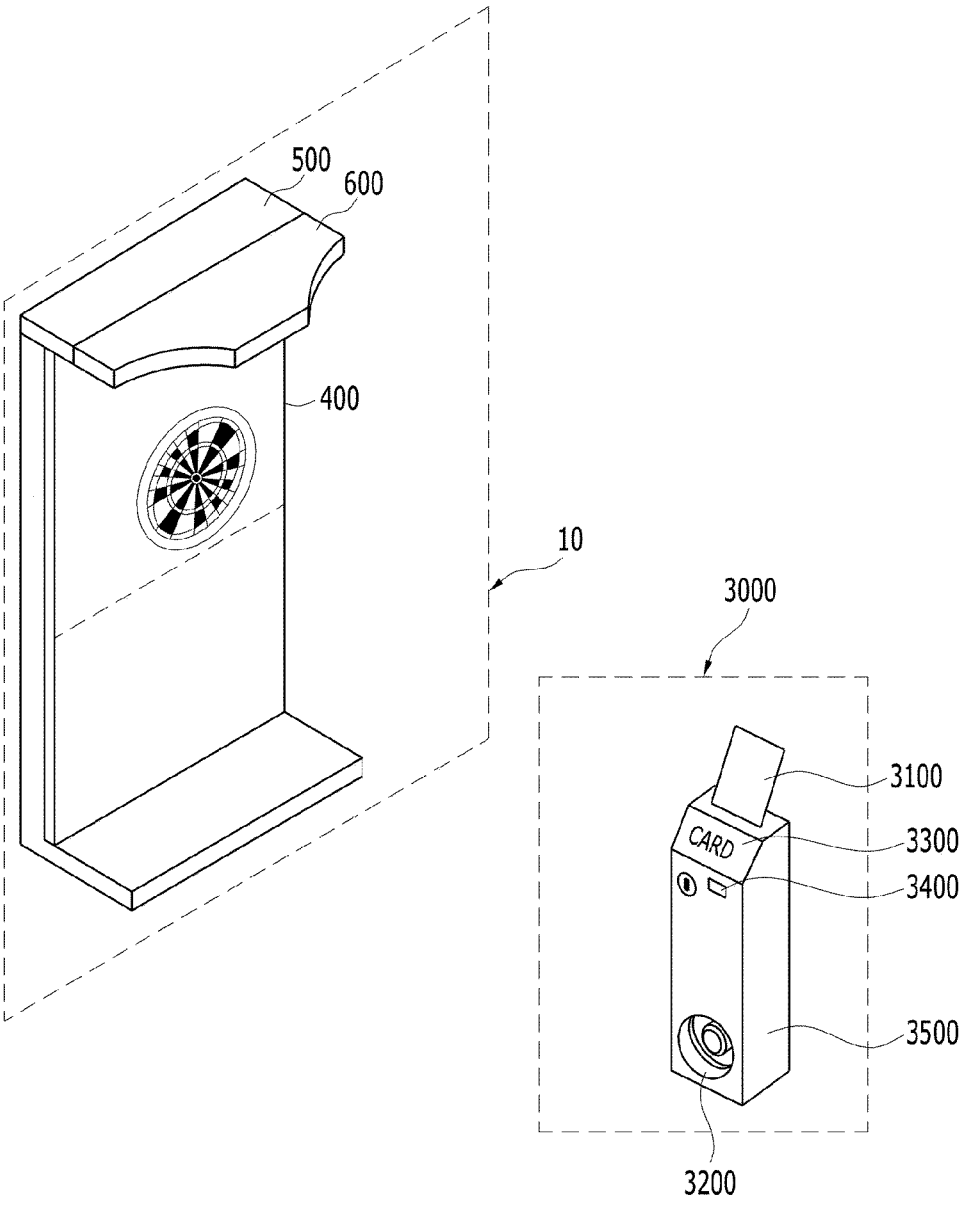
FIG. 2 is a diagram for describing an example of a dart game system according to some exemplary embodiments of the present disclosure.

Specifically, the camera unit 140 may include a first camera disposed to face a front surface of the body part (400 in FIG. 2). Further, the camera unit 140 may include a second camera disposed on the front surface of the body part to photograph at least one user who uses the dart game apparatus. However, the present disclosure is not limited thereto. Here, the first camera may photograph the dart target and the second camera may photograph the user.

The image photographed by the camera unit 140 may be output to the display unit 120 through control by the control unit 110.

In this case, the image photographed by the camera unit 140 may be output to different areas within the display unit 120. For example, an area in which the image photographed by a first camera included in the camera unit 140 is displayed may be different from an area in which the image photographed by a second camera included in the camera unit 140 is displayed. In this case, the image photographed by the first camera may include an image for the dart target. Further, the image photographed by the second camera may include an image of the dart game user. However, the present disclosure is not limited thereto.

A location at which the image photographed by the camera unit 140 is output may vary depending on the dart game user. For example, a location where the photographed image is displayed when the camera unit 140 photographs an image related to the dart game of a first user and a location where the photographed image is displayed when an image related to the dart game of a second user is photographed by the camera unit 140 may be different from each other.

In the exemplary embodiment of the present disclosure, at least one of the cameras constituting the camera unit 140 may be used to measure a throwing speed of the dart pin. For example, at least one camera photographs two or more dart pin images at a predetermined time interval to measure a movement speed of the dart pin. As another exemplary embodiment, the movement speed of the dart pin may be measured using the images of the dart pins photographed by the two or more cameras and positional relationship information of the two or more cameras, which is preset. However, the present disclosure is not limited thereto.

The first network module 150 may perform a communication function with the dart game assistant apparatus 3000 and at least one user terminal under the control by the control unit 110.

The first network module 150 may use various wired communication systems such as public switched telephone network (PSTN), x digital subscriber line (xDSL), rate adaptive DSL (RADSL), multi rate DSL (MDSL), very high speed DSL (VDSL), universal asymmetric DSL (UADSL), high bit rate DSL (HDSL), and local area network (LAN).

The first network module 150 presented here may use various wireless communication systems such as code division multi access (CDMA), time division multi access (TDMA), frequency division multi access (FDMA), orthogonal frequency division multi access (OFDMA), single carrier-FDMA (SC-FDMA), and other systems.

In the present disclosure, the first network module 150 may be configured regardless of communication modes such as wired and wireless modes and constituted by various communication networks including a personal area network (PAN), a wide area network (WAN), and the like. Further, the network may be known World Wide Web (WWW) and may adopt a wireless transmission technology used for short-distance communication, such as infrared data association (IrDA) or Bluetooth.

The sensing unit 160 may sense the play of a dart game player (e.g., a real player) input into the dart target 300.

For example, the sensing unit 160 may sense the hit location of the dart pin. The sensing unit 160 may electrically convert a score corresponding to the area which the dart hits to transmit the converted score to the control unit 110. In this case, the control unit 110 may acquire a score based on information on the hit location of the dart, which is acquired from the sensing unit 160.

Meanwhile, the sensing unit 160 may include piezoelectric elements. The piezoelectric elements may mean any type of element that generates an electrical signal in response to a change or change rate of pressure applied to the element. When the dart pin hits the dart target 300, the electrical signal may be generated by the piezoelectric element in accordance with the pressure applied to the corresponding segment. At least partially based on the electrical signal, the control unit 110 may determine a speed of the dart pin.

For example, the dart pin is thrown and flies, and reaches the dart target and stops. When the dart pin is completely stopped and there is no change in the shape of the piezoelectric element due to the dart pin, the electrical signal of the piezoelectric element also disappears. Therefore, an interval between the time when voltage starts to be generated by the piezoelectric element and the time when the generation of the electrical signal by the piezoelectric element disappears may be measured. When the measured time and acceleration are known, a throwing speed of the dart pin may be calculated.

The user input unit 170 receives an input of the user for controlling the dart game apparatus 10. The user input unit 170 may be implemented by at least one of a keypad, a dome switch, a touch pad (resistive/capacitive), a jog wheel, and a jog switch. However, the present disclosure is not limited thereto.

In the present disclosure, the user input unit 170 may also include a short-range communication unit (not illustrated). When the user input unit 170 includes the short-range communication unit of the first network module 150, the user input unit 170 may be configured to receive the user input which is input by an external device.

For example, when the user input unit 170 performs the short range communication using infrared communication, the external device may be an infrared remote controller. As another example, when the user input unit 170 performs the short range communication using a Bluetooth function, the external console device may be a mobile device including a Bluetooth module. The mobile device including the Bluetooth module may be, for example, a smartphone.

In the present disclosure, the user input unit 170 may receive information on the dart pin. For example, the dart game system 1000 may be input with information included in a dart pin identification module such as an NFC chip or an RFID chip embedded in the dart pin through the user input unit 170. As an example, the information on the dart pin may include mass information, weight information, manufacturer information, length information, shape information, and/or predetermined identification information for identifying the dart pin.

Meanwhile, in the present disclosure, the user input unit 170 may be provided in the dart game assistant apparatus 3000. In this case, the motion and the function which may be performed through the user input unit 170 may be replaced or paralleled with at least one of the components provided in the dart game assistant apparatus 3000. A detailed description for the dart game assistant apparatus 3000 will be described below.

The illumination unit 180 may output a signal for announcing occurrence of an event of the dart game apparatus 10. Here, the event which occurs in the dart game apparatus 10 may be identification of the dart game player, direct hit of the dart, a change of the dart game player, game over, and the like.

The illumination unit 180 may include a light emission diode (LED) and announce the occurrence of the event to the user by flickering the LED. The illumination unit 180 may vary and output the type of light emission, the intensity of light emission, or the flicker cycle depending on the position at which the dart pin reaches the dart target.

Meanwhile, the illumination unit 180 may be disposed on the bottom of the dart target 300 and flickered according to a flickering pattern which is pre-stored according to the occurrence of the event. For example, one or more LEDs may be allocated to respective parts of the dart target 300. The allocated LEDs are disposed on the bottom of the dart target 300 and may be disposed in a direction orienting the outside of the dart game apparatus 10. When the LEDs irradiate light, the light irradiated by the LEDs may pass through the dart target 300 made of a transparent or translucent material to transfer a visual output to the user. Alternatively, the light irradiated by the LEDs may transfer the visual output to the user through a gap existing in the dart target 300. As another example, the LEDs may be arranged linearly or nonlinearly along both sides of the dart game apparatus 10. In this case, the LEDs may extend to a bottom along both sides of the dart game apparatus 10 and may be disposed additionally extend along the side of the throwline. However, the present disclosure is not limited thereto.

The sound output unit 190 may output audio data received from the first network module 150 or stored in the memory during a motion such as a sound effect of the game, a game motion guide, a game method description, and the like. The sound output unit 190 may also output a sound signal related with a function (e.g., the game sound effect) performed by the dart game apparatus 10. The sound output unit 190 may also output a speech of a game player or a third person using another dart game apparatus, which is received through the first network module 150. The sound output unit 190 may include a receiver, a speaker, a buzzer, and the like. Additionally, the sound output unit 190 may vary and output a volume/a type of music according to the location where the dart pin reaches the dart target. However, the present disclosure is not limited thereto.

The target illumination unit 200 may irradiate light toward the front surface of the body part 400. For example, the target illumination unit 200 may irradiate the light toward the dart target 300. However, the present disclosure is not limited thereto.

Meanwhile, the target illumination unit 200 may output the signal for announcing the occurrence of the event of the dart game apparatus 10.

For example, the target illumination unit 200 may include the LED to irradiate the light toward the front surface of the body part 400 through flicking of the LED. Additionally, the target illumination unit 200 may vary and output the type of light emission, the intensity of light emission, and/or the flicker cycle depending on the location at which the dart pin reaches the dart target 300. However, the present disclosure is not limited thereto.

In the present disclosure, a target illumination unit 200 may be disposed in a lid unit (600 in FIG. 2). However, although not limited thereto, the target illumination unit 200 may be disposed at least partially in contact with the cover unit 130. For example, the target illumination unit 200 may be disposed on one surface of the cover unit 130 facing the dart game apparatus 10.

Meanwhile, the control unit 110 may determine the area where the target illumination unit 200 irradiates the light at least partially based on the location which the dart pin hits.

For example, when the dart pin reaches the dart target 300, the sensing unit 160 may obtain information on the location where the dart pin reaches the dart target 300 and the control unit 110 may determine the area to which the target illumination unit 200 irradiates the light at least partially based on the obtained location information.

Specifically, the control unit 110 may determine the area which the dart pin hits as the area where the target illumination unit 200 irradiates the light.

A portion adjacent to a point where a line extending from the center of the dart target 300 to the location which the dart pin hits meets the outline of the dart target may be determined as the area to which the target illumination unit 200 irradiates the light.

Meanwhile, the control unit 110 may determine a portion matching the location which the dart pin hits as the area to which the target illumination unit 200 irradiates the light. For example, when the dart pin hits a specific location, the control unit 110 may determine an area matching the hit location as the area to which the target illumination unit 200 irradiates the light.

The control unit 110 may determine a portion matching an area including the location which the dart pin hits as a location at which an event effect is to be displayed. For example, the dart target 300 may be divided into a plurality of fan-shaped areas and the control unit 110 may determine a portion adjacent to an arc of the fan-shaped area including the portion which the dart pin hits as the area to which the target illumination unit 200 irradiates the light.

The control unit 110 may determine an area which belongs to a predetermined distance range from the location within the dart target to which the dart pin is thrown as the area to which the target illumination unit 200 irradiates the light.

Meanwhile, the control unit 110 may determine at least one of a pattern in which the target illumination unit 200 irradiates the light and a duration of the irradiated light, at least partially based on the location which the dart pin hits.

Specifically, when the dart pin hits a predetermined location, the control unit 110 may determine a pattern based on the location where the dart pin is determined as the pattern in which the target illumination unit 200 irradiates the light.

As an example, in the case where the dart pin hits a double score area, the control unit 110 may control the target illumination unit 200 to flicker twice or control the target illumination unit 200 to irradiate the light during a duration which is relatively two times longer than the case where the dart pin hits a single score area.

As another example, in the case where the dart pin hits a triple score area, the control unit 110 may control the target illumination unit 200 to flicker three times or control the target illumination unit 200 to irradiate the light during a duration which is relatively three times longer than the case where the dart pin hits a single score area. However, the present disclosure is not limited thereto.

The dart target 300 may include a score board in which a bull's eye is positioned at the center and there are areas segmented by a concentric circle centering the bull's eye and straight lines extended radially from the bull's eye and granted with individual scores, respectively.

Multiple receiving grooves into which a tip of a dart may be inserted may be formed on the score board. In this case, shapes of areas at which the scores are arranged and to which the scores are granted in the dart target 300 may be variably changed. Further, the dart target 300 may be implemented in the form of a touch screen. However, the present disclosure is not limited thereto.

In the present disclosure, the dart game apparatus 10 may further include a memory (not illustrated).

The memory may store a program for a motion of the control unit 110 therein and temporarily store input/output data (e.g., a phone book, a message, a still image, a moving picture, or the like) therein.

The memory may store data regarding various patterns of vibrations and sounds output to correspond to the motion input through the user input unit.

The memory may include at least one type of storage medium of a flash memory type storage medium, a hard disk type storage medium, a multimedia card micro type storage medium, a card type memory (for example, an SD or XD memory, or the like), a random access memory (RAM), a static random access memory (SRAM), a read-only memory (ROM), an electrically erasable programmable read-only memory (EEPROM), a programmable read-only memory (PROM), a magnetic memory, a magnetic disk, and an optical disk. The dart game apparatus 10 may operate in connection with a web storage performing a storing function of the memory on the Internet. However, the present disclosure is not limited thereto.

In the present disclosure, the dart game assistant apparatus 3000 may have various components for the function which may be performed by the dart game apparatus 10 and a function which may be autonomously performed. Further, the dart game assistant apparatus 3000 may be disposed on the ground while being spaced apart from the dart game apparatus 10 by a predetermined distance in an opposite direction to the dart target 300. However, the present disclosure is not limited thereto.

The dart game assistant apparatus 3000 may include a user interface unit 3100, an audio output unit 3200, a user recognition unit 3300, a storage unit 3400, and a support member 3500. However, the present disclosure is not limited thereto.

The user interface unit 3100 may be a device that receives an input of the user for controlling the dart game apparatus 10. The user interface unit 3100 may include a keypad, a dome switch, a touch pad (resistive/capacitive), a jog wheel, a jog switch, a touch screen having a display function, and like. However, the present disclosure is not limited thereto.

The user interface unit 3100 may receive an input of the user for controlling the display unit 120 of the dart game apparatus 10. For example, the dart game user may adjust the size of the variable screen displayed on the display unit 120 through the user interface unit 3100. Specifically, the display unit 120 may be divided into a plurality of areas and at least one of the sizes of the plurality of respective areas may be adjusted by the user interface unit 3100.

At least one location among the plurality of areas may be adjusted by the user interface unit 3100. Specifically, the location of at least one of the plurality of areas may be moved to the upper portion of the display unit 120 by an input of a user input from the user interface unit 3100. Further, the location of at least one of the plurality of areas may be moved to the lower portion of the display unit 120 by an input of a user input from the user interface unit 3100.

A screen displayed in at least one area among the plurality of areas included in the display unit 120 may be adjusted by the user interface unit 3100. For example, when the variable screen for the dart game user is preset to be displayed in a first area, the preset display of the variable screen may be changed to displaying the screen for the dart target 300 by the control signal input through the user interface unit 3100. As another example, the screen for game progress information may be set to be displayed in the first area by the control signal input through the user interface unit 3100.

In this case, the screen adjusted by the user interface unit 3100 may include at least one of the image photographed by the camera unit 140, an image received from another dart game apparatus, an image received from the external device, information on the dart game which is currently progressed, acquired information depending on a current dart hitting location, the event effect of the dart game, a lesson image for the dart game, an expected acquired score, and an advertisement image. However, the present disclosure is not limited thereto.

Meanwhile, the screen may be displayed even in the user interface unit 3100. Here, the screen displayed in the user interface unit 3100 may include at least one of the image photographed by the camera unit 140, an image received from another dart game apparatus, an image received from the external device, information on the dart game which is currently progressed, acquired information depending on a current dart hitting location, the event effect of the dart game, a lesson image for the dart game, an expected acquired score, and an advertisement image.

In this case, the screen displayed in the display unit 120 and the screen displayed in the user interface unit 3100 may be interlocked. For example, the screen displayed in the user interface unit 3100 may be the same as at least one of the variable screens displayed in the display unit 120.

Alternatively, the screen displayed in the user interface unit 3100 may be a reduced screen of at least one of the screens displayed in the display area.

In this case, the screen displayed on the user interface unit 3100 may be at least one of the images displayed in the display unit 120, which may be adjusted by the control signal received by the user interface unit 3100. For example, a plurality of screens may be displayed in the display unit 120, and a screen selected by the user through the user interface unit 3100 among the plurality of variable screens may be displayed in the user interface unit 3100. However, the present disclosure is not limited thereto.

The control unit 110 may adjust the input information that may be input by the user interface unit 3100, partially based on at least one of the identification information of the user and pre-stored user designation information. For example, each of the dart game users may pre-store the information that may be input through the user interface unit 3100 and when the user is identified based on the identification information acquired by the dart game apparatus 10, the control unit 110 may adjust the information which may be input through the user interface unit 3100 based on the pre-stored information. In this case, the adjusted information may include at least one of the information on selection and cancellation of the game mode, the information on selection and cancellation of the player, information on a dart game execution history, information on user authentication, and information related with payment of a dart game expense, but is not limited thereto.

The control unit 110 may determine whether to activate the user interface unit 3100 partially based on at least one of the identification information of the user and the pre-stored user designation information. For example, each of the dart game users may pre-store information indicating whether to use the user interface unit 3100 and when the dart game user is identified based on the identification information acquired by the dart game apparatus 10, the control unit 110 may determine whether to activate the user interface unit 3100 based on the pre-stored information. However, the present disclosure is not limited thereto.

The audio output unit 3200 interlocks with the dart game apparatus 10 to output a sound related to an event generated in the dart game apparatus 10. For example, the audio output unit 3200 may output audio data received from the first network module 150 or stored in the memory in a sound effect of the game, a game motion guide, game method description, and the like. The audio output unit 3200 may output a sound signal related with the function (e.g., the game sound effect) performed by the dart game apparatus 10. The audio output unit 3200 may also output a speech of a game player or a third person using another dart game apparatus, which is received through the first network module 150. The audio output unit 3200 may include a receiver, a speaker, a buzzer, and the like. However, the present disclosure is not limited thereto.

Meanwhile, the audio output unit 3200 may vary and output a volume/a type of music according to the location where the dart pin reaches the dart target 300. Additionally, the audio output unit 3200 may vary and output the volume/the type of music so as to correspond to the speed of the dart pin.

In this case, the audio output unit 3200 is positioned relatively closer to the dart game user than the sound output unit 190 provided in the dart game apparatus 10 and generates the sound to enhance an interest of the dart game.

The user recognition unit 3300 may recognize unique information of a long-range user by using a radio wave through the radio frequency identification (RFID) technology which is a kind of the short range communication technology. For example, the user may possess a card, a mobile terminal, or unique dart game equipment (for example, his/her own personal dart equipment) which includes an RFID module. Information (e.g., a personal ID, an identification code, and the like of the user registered in the database server) for identifying the user may be recorded in the RFID module possessed by the user. The user recognition unit 3300 may identify the RFID module possessed by the user to identify a dart game player which plays the game by using the dart game apparatus 10 and update a database for the identified dart game player or accumulate new data.

Meanwhile, the user recognition unit 3300 may use various technologies (e.g., the short-range communication technology such as the Bluetooth, and the like) that may transmit and receive unique information of the user by a contact/non-contact method in addition to the RFID technology. Further, the user recognition unit 3300 may include a biodata identification module that identifies biodata (speech, a fingerprint, and a face) of the user by interworking with the microphone of the user interface unit 3100, the touch pad, the camera unit 140, and the like.

Meanwhile, the user recognition unit 3300 may include at least one camera which may recognize a QR code, a barcode, etc.

Specifically, when the QR code or the barcode is provided in the dart pin of at least one user or the user terminal of at least one user, at least one camera may recognize at least one of the QR code or the barcode. In addition, information recognized by at least one camera may be transmitted to the dart game apparatus 10 under the control by the control unit 110. In this case, the dart game apparatus 10 may check a game credit of at lest one user based on at least one received information or at least one user may display a preset screen in the display unit 120. However, the present disclosure is not limited thereto.

The storage unit 3400 may store a bill or a coin for performing the dart game. For example, the storage unit 3400 may store bills such as 1000 won or 5000 won directly from the dart game user.

The storage unit 3400 can acquire game credits from the dart game user. For example, the storage unit 3400 may acquire the game credits through the RFID card of the dart game user and acquire the game credits through the first network module 150. Here, the game credit may mean money required for performing the dart game.

Meanwhile, a credit card or a check card for performing the dart game may be inserted into the storage unit 3400. In this case, the control unit 110 settles the game credit by using the credit card or the check card inserted into the storage unit 3400 to generate the dart game credit. Further, although not limited thereto, the storage unit 3400 may acquire the game credit from the user by various methods.

The support member 3500 may form an external appearance of the dart game assistant apparatus 3000.

Specifically, the support member 3500 may be provided by forming a predetermined height from the ground so that the user conveniently uses the user interface unit 3100.

The second network module 3600 may perform a communication function with the dart game apparatus 10 and at least one user terminal under the control by the control unit 110.

The second network module 3600 may use various wired communication systems such as public switched telephone network (PSTN), x digital subscriber line (xDSL), rate adaptive DSL (RADSL), multi rate DSL (MDSL), very high speed DSL (VDSL), universal asymmetric DSL (UADSL), high bit rate DSL (HDSL), and local area network (LAN).

The second network module 3600 presented here may use various wireless communication systems such as code division multi access (CDMA), time division multi access (TDMA), frequency division multi access (FDMA), orthogonal frequency division multi access (OFDMA), single carrier-FDMA (SC-FDMA), and other systems.

In the present disclosure, the second network module 3600 may be configured regardless of communication modes such as wired and wireless modes and constituted by various communication networks including a personal area network (PAN), a wide area network (WAN), and the like. Further, the network may be known World Wide Web (WWW) and may adopt a wireless transmission technology used for short-distance communication, such as infrared data association (IrDA) or Bluetooth.

According to the above-described configuration, the dart game system 1000 may provide, to the user, a dart game including various convenience and entertainments through the dart game apparatus 10 and the dart game assistant apparatus 3000 provided outside the dart game apparatus 10. Hereinafter, a shape of the dart game system 1000 which may be implemented in the present disclosure will be described through FIG. 2.

FIG. 2 is a diagram for describing an example of a dart game system according to some exemplary embodiments of the present disclosure. The contents disclosed in FIG. 1 are referred to for a feature duplicated with the feature described above in relation to FIG. 1 among the features for the contents illustrated in FIG. 2 and here, a description thereof will be omitted.

Referring to FIG. 2, the dart game system 1000 may include the dart game apparatus 10 and the dart game assistant apparatus 3000.

The dart game user may enjoy the dart game through the dart game apparatus 10.

When the dart game apparatus 10 is provided in one area, the dart game assistant apparatus 3000 may be disposed spaced apart by a predetermined distance in an opposite direction to the dart target 300.

In this case, the input for the dart game apparatus 10 is performed through the user interface unit 3100 provided in the dart game assistant apparatus 3000, and as a result, various situations may not occur, which are inconvenient for the dart game user.

For example, the dart game user may perform the input in the dart game apparatus 10 through the user interface unit 3100 provided in the dart game assistant apparatus 3000, and as a result, there is no need to move to the dart game apparatus 10 in order to perform the input in the dart game apparatus 10. In particular, this allows the dart game user to directly perform the input for the dart game without the need to move to the dart game apparatus 10 when the dart game user is a disabled person (e.g., a person with a leg injury, etc.).

Meanwhile, the support member 3500 may include the user interface unit 3100 provided on the upper surface thereof. Further, the storage unit 3400 for acquiring the game credit from at least one user may be provided on the front surface of the support member 3500. Accordingly, at lest one user may conveniently use the dart game assistant apparatus 3000. However, the present disclosure is not limited thereto.

Meanwhile, in the present disclosure, the display unit 120 may be provided in an area other than an area in which the dart target 300 is provided on the front surface of the dart game apparatus 10. Hereinafter, the shape of the dart game apparatus 10 in the present disclosure will be described through FIG. 3.

Figure 3:
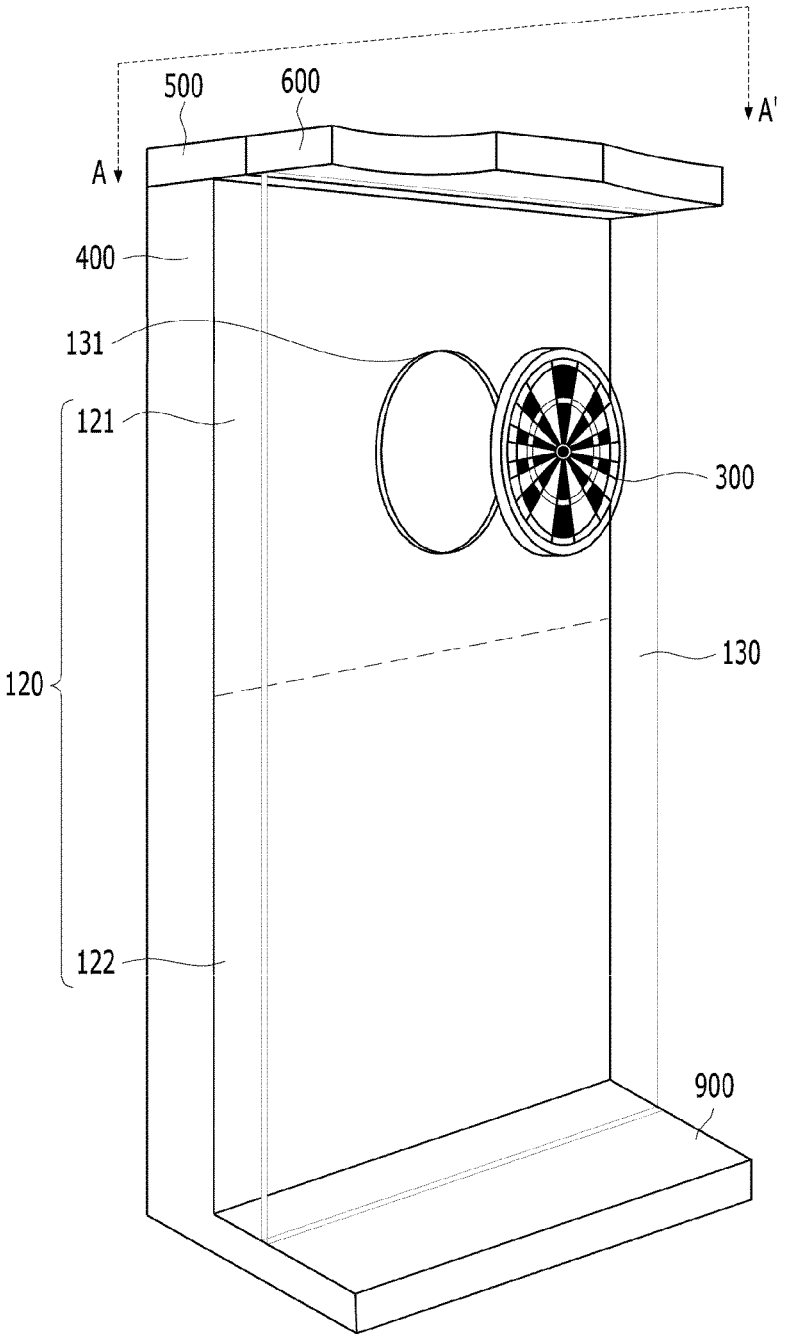
FIG. 3 is a perspective view for describing a dart game apparatus according to some exemplary embodiments of the present disclosure.

FIG. 3 is a perspective view for describing a dart game apparatus according to some exemplary embodiments of the present disclosure.

Referring to FIG. 3, the dart game apparatus 10 may include a display unit 120, a cover unit 130, a dart target unit 300, a body part 400, a support unit 500, a lid unit 600, and a lower support unit 900. However, components described above are not required in implementing the dart game apparatus 10 and the dart game apparatus 10 may thus have components more or less than components listed above.

In the present disclosure, the display unit 120 may be formed in an area other than an area in which the dart target unit 300 is provided on the front surface of the dart game apparatus 10. However, although not limited thereto, the display unit 120 may be formed on at least a part of the front surface of the dart game apparatus 10.

The display unit 120 may include a first display area 121 and a second display area 122. However, although not limited thereto, the display unit 120 may include at least one display area.

For example, the display unit 120 may be formed by one display unit area. As another example, the display unit 120 may also include three or more display areas.

Each display area provided in the display unit 120 may be independently controlled by the control unit 110.

For example, different images may be output to the first display area 121 and the second display area 122, respectively. As another example, the first display area 121 and the second display area 122 may also interlock with each other and output a single image or video. However, the present disclosure is not limited thereto.

Meanwhile, according to some exemplary embodiments of the present disclosure, the dart target unit 300 may be provided on the front surface of the display unit 120. For example, the dart target unit 300 may be coupled to the display unit 120 through a target fixation plate which may be provided on the front surface of the display unit 120, etc. Hereinafter, a method in which the dart target unit 300 is coupled to the display unit 120 will be described below through FIGS. 4 to 10.

The cover unit 130 may be provided adjacent to the display unit 120 and protect the display unit 120. For example, the cover unit 130 may be provided spaced apart from the display unit 120 by a predetermined distance. As another example, the cover unit 130 may be provided in contact with the display unit 120. In this case, the cover unit 130 may reduce a damage risk to the display unit 120. Meanwhile, the cover unit 130 may also include a hole (131 in FIG. 3) for receiving the dart target unit 300. Hereinafter, the hole 131 provided in the cover unit 130 will be described below through FIG. 4.

The body part 400 may form the external appearance of the dart game apparatus 10 in a rectangular plate form erected from the ground. However, although not limited thereto, the body part 400 may be formed in various forms such as a rectangular pillar shape or a polygonal shape. Further, a space may be provided inside the body part 400. In this case, the control unit 110 may be provided in an internal space of the body part 400. However, the present disclosure is not limited thereto.

The support unit 500 may be provided on an upper side of the body part 400 and serve to connect and support the lid unit 600 to be described subsequently and the body part 400.

The lid unit 600 may be rotatably coupled to the support unit 500 through at least one hinge.

Specifically, one side of at least one hinge may be coupled to a lower surface of the lid unit 600. The other side of at least one hinge may be provided on the lower surface of the support unit 500. Accordingly, the lid unit 600 may be unfolded so as to be formed in a "¬" shape with the body part 400 when the dart game apparatus 10 is used, and folded when carrying is required. However, the present disclosure is not limited thereto.

The lower support unit 900 may be formed to extend in a throw-line direction from an end portion contacting the body part 400 along the ground. Further, the lower support unit 900 may serve to support the body part 400 to be erected from the ground. Meanwhile, according to some exemplary embodiments of the present disclosure, at least one of the camera unit 140, the illumination unit 180, and the sound output unit 190 may be provided even in the lower support unit 900. However, the present disclosure is not limited thereto.

According to the above-described components, the dart game apparatus 10 may include the display unit 120 capable of outputting the screen to the front surface of the body part 400.

Meanwhile, according to some exemplary embodiments of the present disclosure, the dart target unit 300 may be provided on at least one of the front surface of the display unit 120 or the cover unit 130. Hereinafter, an example of a method in which the dart target unit 300 will be described through FIG. 4.

Figure 4:
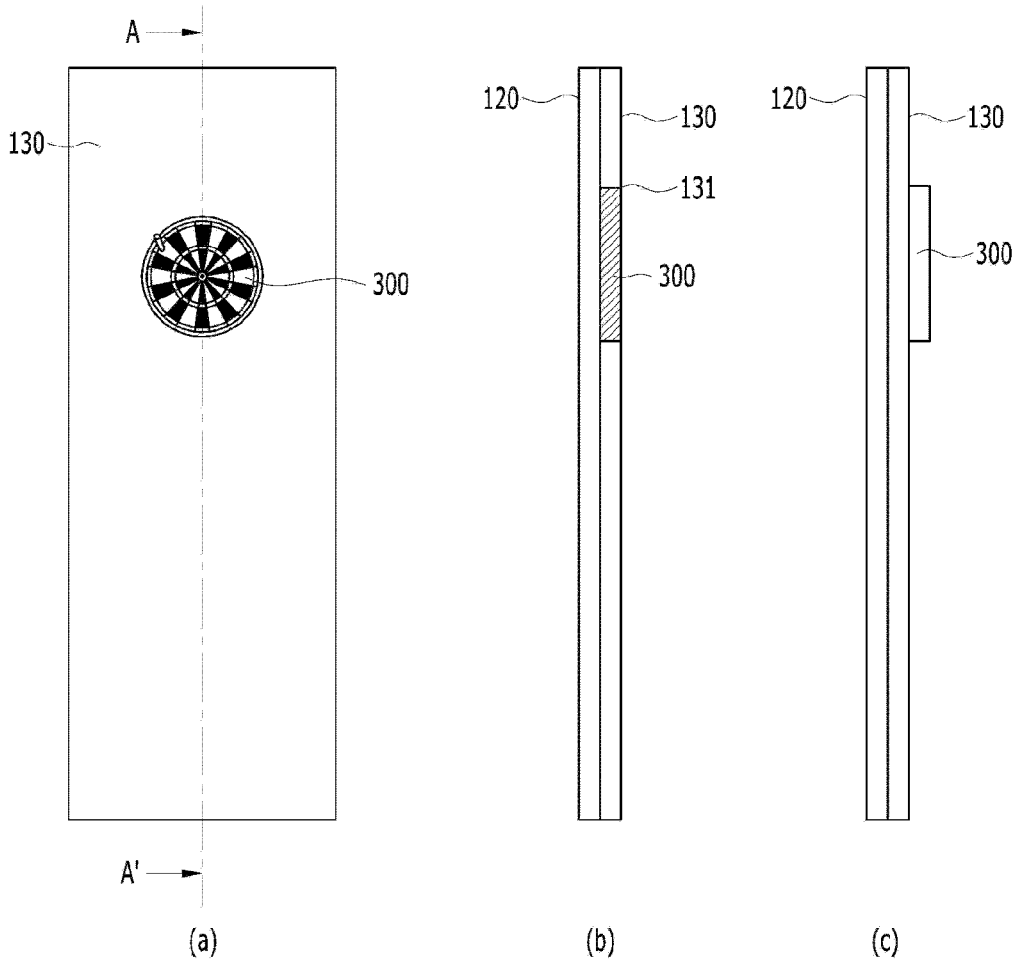
FIG. 4 is a cross-sectional view for describing an example of a method in which a dart target unit is coupled to at least one of a display unit or a cover unit according to some exemplary embodiments of the present disclosure.

FIG. 4 is a cross-sectional view for describing an example of a method in which a dart target unit is coupled to at least one of a display unit or a cover unit according to some exemplary embodiments of the present disclosure.

Referring to FIG. 4A, the dart target unit 300 may be seated on at least one of the display unit 120 or the cover unit 130.

Meanwhile, FIGS. 4B and 4C are diagrams illustrating a cross-sectional view taken along line A-A' of FIG. 4A.

Specifically, referring to FIG. 4B, the hole 131 through which the dart pin may pass may be generated in the cover unit 130 to correspond to the size of the dart target unit 300. In addition, the dart target unit 300 may be seated on the front surface of the display unit 120. Accordingly, the dart pin thrown by a player may reach the dart target unit 300 by passing through the hole 131 provided in the cover unit 130.

Meanwhile, referring to FIG. 4B, the hole 131 may not be provided in the cover unit 130. In this case, the dart target unit 300 may be coupled to the cover unit 130 through the target fixation plate which may be provided on the front surface of the cover unit 130, etc. However, the present disclosure is not limited thereto.

Meanwhile, according to some exemplary embodiments of the present disclosure, the dart target unit 300 and the target cover unit provided on the front surface of at least one of the display unit 120 or the cover unit 130 may be detachably coupled through the target fixation plate, etc. Hereinafter, a method in which the dart target unit 300 is detached will be described through FIGS. 5 to 10.

Figure 5:
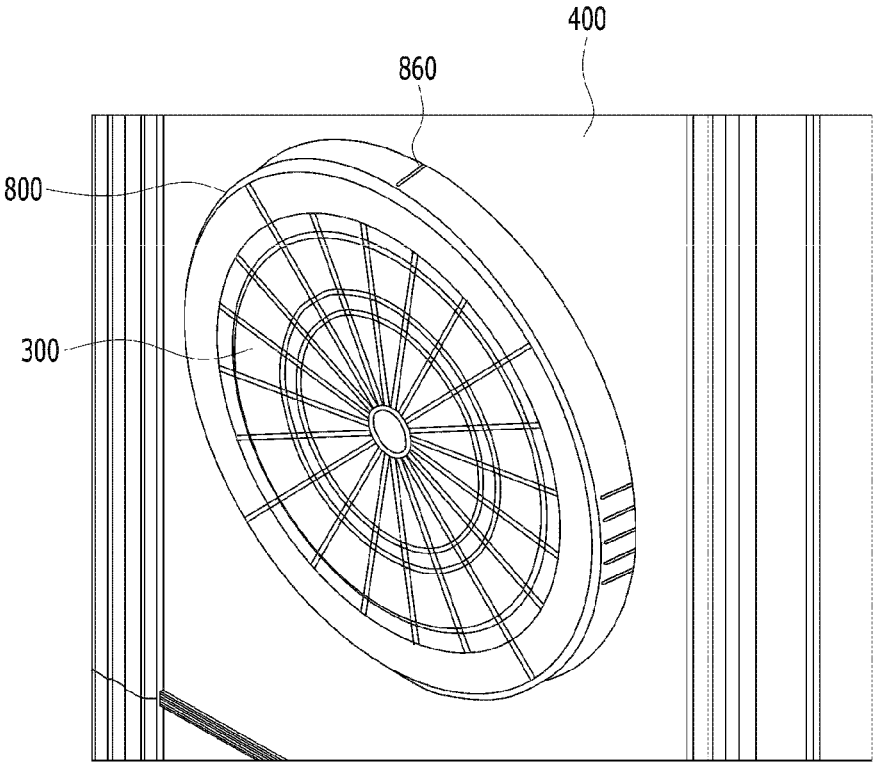
FIG. 5 is a perspective view for describing a dart target unit according to some exemplary embodiments of the present disclosure.

FIG. 5 is a perspective view for describing a dart target unit according to some exemplary embodiments of the present disclosure.

Referring to FIG. 5, the dart game apparatus 10 may include a dart target unit 300, a body part 400, and a target cover unit 800. However, the present disclosure is not limited thereto.

The body part 400 may form the external appearance of the dart game apparatus 10. Further, the display unit 120 and the cover unit 130 may be provided on the front surface of the body part 400. However, the present disclosure is not limited thereto.

The dart target unit 300 may be provided on the front surface of the body part 400.

As an example, the dart target unit 300 may be seated on the cover unit 130 provided on the front surface of the body part 400. In addition, the dart target unit 300 may be fixed to the front surface of the cover unit 130 through the cover unit 800 to be described below. However, the present disclosure is not limited thereto.

The dart target unit 300 may be seated on the display unit 120 provided on the front surface of the body part 400. In addition, the dart target unit 300 may be fixed to the front surface of the display unit 120 through the target cover unit 800.

In this case, the hole 131 through which the dart pin may pass may be generated in the cover unit 130 to correspond to the size of the target cover unit 800. In addition, the dart target unit 300 may be seated on the front surface of the display unit 120. Accordingly, the dart pin thrown by a player may reach the dart target unit 300 by passing through the hole 131 provided in the cover unit 130.

Meanwhile, the target fixation plate for fixing the dart target unit 300 may be provided in one area of the front surface of the body part 400. In this case, the target fixation plate may be fixed to at least one o the display unit 120 or the cover unit 130 provided on the front surface of the body part 400 through a bolt, etc. However, although not limited thereto, the target fixation plate may also be formed integrally with the cover unit 130, etc.

When the target fixation plate is provided on the front surface of the body part 400, the dart target unit 300 may be seated on the front surface of the target fixation plate.

Meanwhile, according to some exemplary embodiments of the present disclosure, at least one guide pin may be provided on the front surface of the body part 400, which guides a location at which the dart target unit 300 is seated on the front surface of the body part 400.

Specifically, the dart target unit 300 may include a score board in which there are areas segmented by a concentric circle centering the bullseye and straight lines extended radially from the bullseye and granted with individual scores, respectively. The score board may be an important area for determining a score of the dart game. Accordingly, at least one guide pin may be provided on the front surface of the body part 400, which guides the score board to be provided at an accurate location.

The target cover unit 800 may seat the dart target unit 300 on the body part 400.

Specifically, the target cover unit 800 may be formed to cover at least a part of the dart target unit 300 and may be fixed and coupled to the target fixation plate while covering at least a part of the dart target unit 300. Accordingly, the dart target unit 300 may be fixed to the front surface of the body part 400. Hereinafter, a method in which the target cover unit 800 fixes the dart target unit 300 will be described below through FIG. 6.

Meanwhile, in the present disclosure, a part of the front surface of the target cover unit 800 may also be a foul area. In this case, at least one vibration sensor unit may also be provided in a part of the front surface of the target cover unit 800, which may sense an impact amount or a vibration amount of the dart pin thrown from the user. In this case, the control unit 110 may recognize whether the dart pin thrown from the user is fouled based on information received from at least one vibration sensor unit. However, the present disclosure is not limited thereto. Hereinafter, the vibration sensor unit will be described below through FIG. 6.

Meanwhile, the target cover unit 800 may include a projected display unit 860 which is formed to be projected on an outer peripheral surface. Here, the projected display unit 860 may display, to the user, that the target cover unit 800 is disposed at a predetermined location. Here, the predetermined location may be predetermined by a manufacturer or the user.

Specifically, in some exemplary embodiments of the present disclosure, the target cover unit 800 may be coupled to the target fixation plate while rotating in a first direction. Here, the first direction may be predetermined by the manufacturer or the user. In this case, the user may check a location at which the projected display unit 860 is disposed through a sense of a sense of touch or a sense of sight.

For example, when the projected display unit 860 is positioned in a 12 o'clock direction, the user may recognize that the target cover unit 800 is normally coupled while rotating in the first direction. Hereinafter, a method in which the target cover unit 800 is rotatably coupled to the target fixation plate will be described through FIG. 6.

Figure 6:
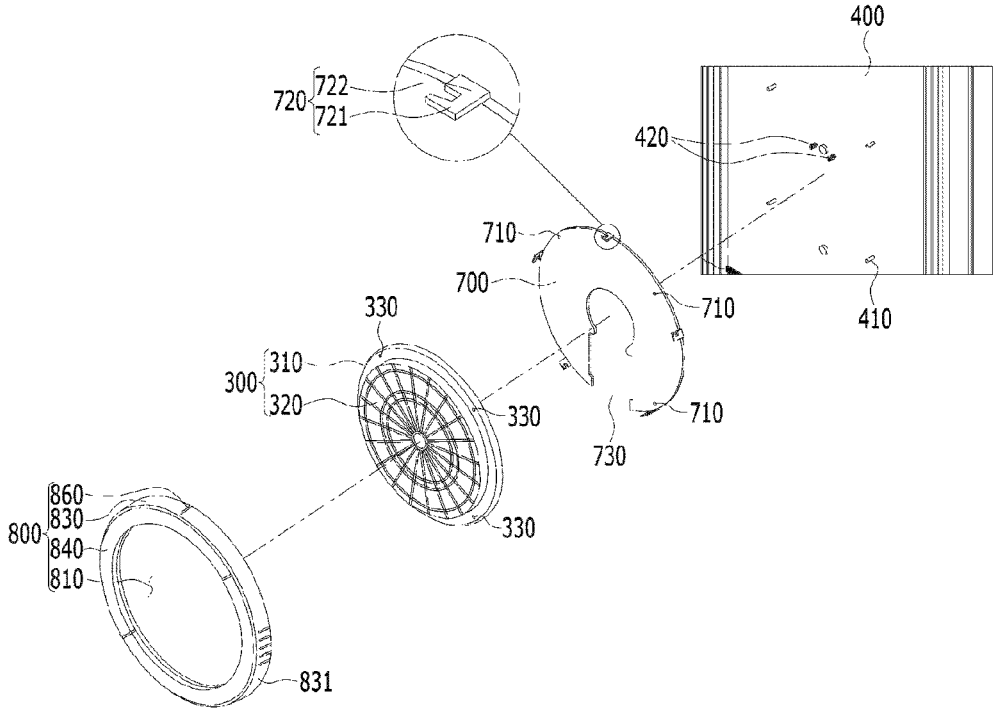
FIG. 6 is an exploded perspective view for describing an example of a method in which the dart target unit is coupled according to some exemplary embodiments of the present disclosure.

FIG. 6 is an exploded perspective view for describing an example of a method in which the dart target unit is coupled according to some exemplary embodiments of the present disclosure.

Referring to FIG. 6, the dart game apparatus 10 may include the body part 400, the target fixation plate 700, the dart target unit 300, and the target cover unit 800. However, components described above are not required in implementing the dart game apparatus 10 and the dart game apparatus 10 may thus have components more or less than components listed above.

The body part 400 may include at least one guide pin 410 and at least one elastic member 420. However, the present disclosure is not limited thereto.

At least one guide pin 410 may be formed to be projected toward the front surface of the body part 400, and may guide locations at which the target fixation plate 700 and the dart target unit 300 are seated on the front surface of the body part 400.

For example, at least one first guide hole 710 which at least one guide pin 410 may penetrate may be provided in the target fixation plate 700. Further, at least one second guide hole 330 which at least one guide pin 410 may penetrate may be provided in the dart target unit 300. At least one guide pin 410 may penetrate at least one first guide hole 710 and at least one second guide hole 330 when the target fixation plate 700 and the dart target unit 300 are seated on the front surface of the body part 400. Accordingly, at least one guide pin 410 may guide the target fixation plate 700 and the dart target unit 300 to be disposed at predetermined locations. Here, the predetermined locations may be predetermined by the manufacturer or the user. However, the present disclosure is not limited thereto.

At least one guide pin 410 is provided in the body part 400 as described above, and as a result, the dart target unit 300 may be seated on the target fixation plate 700 so that the score board provided on the front surface may be provided at an accurate location.

Meanwhile, according to some exemplary embodiments of the present disclosure, at least one guide pin 410 may be coupled to at least one first guide groove (not illustrated) provided in the body part 400.

Specifically, the body part 400 may include at least one first guide groove to which at least one guide pin 410 is fastened so that at least one guide pin 410 may be coupled to the body part 400.

For example, a female thread may be processed in the first guide groove. In addition, a male thread may be processed in at least a part of at least one guide pin 410. In this case, at least one guide pin 410 may be fastened to at least one first guide groove through screw coupling. However, the present disclosure is not limited thereto.

Meanwhile, according to some exemplary embodiments of the present disclosure, the body part 400 may include at least one elastic member 420.

At least one elastic member 420 may provide elastic force so as to fix the dart target unit 300 to the target cover unit 800.

Specifically, when the target cover unit 800 is coupled to the target fixation plate 700 while covering at least a part of the dart target unit 300, at least one elastic member 420 may push the dart target unit 300 toward the target cover unit 800. In such a case, the dart target unit 300 may be in close contact with the target cover unit 800 fixed and coupled to the target fixation plate 700. Accordingly, the dart target unit 300 may be fixed. However, the present disclosure is not limited thereto.

Meanwhile, the target fixation plate 700 may include at least one first guide hole 710, at least one suspension protrusion unit 720, and an opening unit 730. However, the present disclosure is not limited thereto.

At least one guide pin 410 may penetrate at least one first guide hole 710.

Specifically, at least one first guide hole 710 may be provided at a location corresponding to at least one guide pin 410. When the target fixation plate 700 is seated on the front surface of the body part 400, at least one guide pin 410 may penetrate at least one first guide hole 710. Accordingly, the target fixation plate 700 may be disposed at a predetermined location on the front surface of the body part 400. However, the present disclosure is not limited thereto.

Meanwhile, at least one suspension protrusion unit 720 is provided on the outer peripheral surface of the target fixation plate 700 to fix the target cover unit 800.

Specifically, when the target cover unit 800 rotates in the first direction, at least one suspension protrusion unit 720 may have a hook shape so as to be received in at least one receiving groove provided in the target cover unit 800. Here, at least one receiving groove may be provided on a rear surface of the target cover unit 800. A shape for at least one receiving groove will be described below through FIG. 7.

Meanwhile, at least one suspension protrusion unit 720 may be provided in a "⊏" shape so as to be coupled to at least one receiving groove. Alternatively, at least one suspension protrusion unit 720 may also be provided in a "¬" shape. However, the present disclosure is not limited thereto.

Here, at least one suspension protrusion unit 720 may include a suspension member 721 and a connection member 722.

When the target cover unit 800 rotates in the first direction, the suspension member 721 may be inserted into at least one receiving groove provided in the target cover unit 800.

Specifically, the suspension member 721 may be formed so that the suspension member 721 is spaced apart from the target fixation plate 700 by a predetermined distance, and at least a part is inserted into at least one receiving groove provided in the target cover unit 800. However, the present disclosure is not limited thereto. Hereinafter, a method for coupling at least one receiving groove and the suspension member 721 which may be provided in the target cover unit 800 will be described below through FIGS. 7 and 8.

The connection member 722 is formed to extend toward the front surface of the target fixation plate 700 to connect the suspension member 721 and the target fixation plate 700.

Specifically, the connection member 722 may be provided in at least a part of an outer surface or the front surface of the target fixation plate 700 and may be formed to extend toward the front surface of the target fixation plate 700.

As an example, the connection member 722 may be formed to be projected toward the front surface of the target fixation plate 700 in a "|" shape so as to connect the target fixation plate 700 and the suspension member 721. In this case, a shape of the suspension protrusion unit 720 formed by coupling the suspension member 721 and the connection member 722 may be the "¬" shape.

As another example, the connection member 722 which has a "└" shape may be formed to be projected toward the front surface of the target fixation plate 700. In this case, the shape of the suspension protrusion unit 720 formed by coupling the suspension member 721 and the connection member 722 may be a "⊏" shape. However, the present disclosure is not limited thereto.

Meanwhile, the opening unit 730 may be provided in at least a part of the target fixation plate 700 so that at least a part of the front surface of the body part 400 is exposed.

Specifically, at least one elastic member 420 may be provided on the front surface of the body part 400. In this case, the opening unit 730 may be provided in at least a part of the target fixation plate 700 so as to correspond to a location at which at least one least elastic member 420 is provided. Accordingly, at least one elastic member 420 may be in contact with the rear surface of the dart target unit 300 through the opening unit 730.

In this case, the dart target unit 300 may be in close contact with the target cover unit 800 by restoration force of at least one elastic member 420. Accordingly, the dart target unit 300 may be fixed in close contact with the target cover unit 800 fixed and coupled to the target fixation plate 700.

Meanwhile, the dart target unit 300 may include a seating unit 310 and a dart plate 320. However, the present disclosure is not limited thereto.

The seating unit 310 may be seated on the front surface of the target fixation plate 700 and may have a first diameter. Here, the first diameter may be equal to or smaller than a diameter of the target fixation plate 700.

Specifically, when at least one suspension protrusion unit 720 is provided on the outer surface of the target fixation plate 700, the first diameter may be equal to or smaller than the diameter of the target fixation plate 700. Meanwhile, when at least one suspension protrusion unit 720 is provided on the front surface of the target fixation plate 700, the first diameter may be smaller than the diameter of the target fixation plate 700.

That is, the seating unit 310 may have the first diameter so as to be seated on the front surface of the target fixation plate 700 without interference with at least one suspension protrusion unit 720 provided in the target fixation plate 700. However, the present disclosure is not limited thereto.

Meanwhile, the seating unit 310 may include at least one second guide hole 330 provided at a location corresponding to at least one guide pin 410.

When the seating unit 310 is seated in the target fixation plate 700, at least one guide pin 410 may penetrate the second guide hole 330. Accordingly, when the dart target unit 300 may be fixed to the target fixation plate 700, the dart target unit 300 may be disposed at a predetermined location. However, the present disclosure is not limited thereto.

Meanwhile, the dart plate 320 may be formed on the front surface of the seating unit 310 and may include the score board.

Specifically, the dart plate 320 may be formed to be projected toward the front surface of the seating unit 310 and may have a second diameter smaller than the first diameter. Here, the second diameter may also be determined by the score board provided on the front surface of the dart plate 320.

For example, a size of 15.5 inch of the dart target is used as a current International standard. In this case, the second diameter of the dart plate 320 may be 15.5 inch. In such a case, the dart game apparatus 10 may be used even in an International/domestic game and further, used for a practice for a player/ordinary person who participates in the game.

However, although not limited thereto, the second diameter of the dart plate 320 may also be smaller or larger than an International standard size so as to enhance an interest of the user.

Meanwhile, the target cover unit 800 may include an opening unit 810, a front surface unit (820 in FIG. 7), a lateral surface unit 830, and at least one vibration sensor unit 840. However, the present disclosure is not limited thereto.

The front surface unit may be formed to include the opening unit 810 for exposing the dart plate 320 to the outside, and cover at least a part of the dart target unit 300. Here, the opening unit 810 may be formed to correspond to the second diameter of the dart plate 320 In this case, the dart plate 320 may be exposed to the outside of the front surface unit through the opening unit 810, and the dart pin thrown by the user may reach the dart plate 320. That is, the front surface unit may cover the seating unit 310 of the dart target unit 300. However, the present disclosure is not limited thereto.

Meanwhile, the lateral surface unit 830 may form a lateral surface of the target cover unit 800. In addition, the lateral surface unit 830 may cover the lateral surface of the dart target unit 300.

The lateral surface unit 830 may have a height corresponding to a distance by which the dart plate 320 is projected from the front surface of the body part 400.

Specifically, at least one vibration sensor unit 840 to be described below may be disposed on the front surface of the front surface unit. In this case, a first height by which at least one vibration sensor unit 840 is projected from the front surface of the body part 400 needs to be correspond to a second height by which the dart plate 320 is projected from the front surface of the body part. Accordingly, the lateral surface unit 830 may be formed so that the first height may correspond to the second height.

In such a case, the dart target unit 300 viewed by the dart game user may be viewed smooth as if a step is not generated between the dart plate 320 and the target cover unit 800. However, the present disclosure is not limited thereto.

Meanwhile, at least one fastening hole 831 into which at least one bolt is inserted may be provided in the lateral surface unit 830 so that the target cover unit 800 is coupled to the target fixation plate 700.

Specifically, the target cover unit 800 may rotate in the first direction and may be partially coupled to the suspension protrusion unit 720 provided in the target fixation plate 700, and fixed to the target cover unit 800 through at least one bolt inserted into at least one fastening hole 831.

Meanwhile, at least one fastening member to which at least one bolt may be fastened may also be provide on the lateral surface of the target fixation plate 700.

Specifically, at least one fastening member may be formed to extend toward the front surface of the target fixation plate 700 on the outer peripheral surface of the target fixation plate 700. In addition, at least one fastening member may include at least one hole having the female thread so that at lest one bolt is fastened. In this case, when the target cover unit 800 rotates in the first direction, at least one hole may be formed to correspond to a location at which at least one fastening hole 831 is provided. However, the present disclosure is not limited thereto.

In such a case, fixation force with the target cover unit 800 is fixed through at least one bolt may be added to fixation force with which the target cover unit 800 is fixed to the target fixation plate 700 by at least one suspension protrusion unit 720.

Meanwhile, at least one vibration sensor unit 840 may be provided on the front surface of the target cover unit 800.

Specifically, the vibration sensor unit 840 at lest one vibration sensor unit 840 may be provided on the front surface of the front surface unit, and may be positioned on the outer peripheral surface of the dart plate 320 when the target cover unit 800 is coupled to the dart target unit 300. In this case, since the vibration sensor unit 840 is provided outside the dart plate 320, the vibration sensor unit 840 may also be classified into the foul line by a rule of the dart game.

Meanwhile, the control unit 110 may recognize whether the dart pin thrown from the user is fouled by recognizing the vibration amount received from at least one vibration sensor unit 840. For example, when the dart pin thrown from the user hits at least one vibration sensor unit 840 and vibration of a predetermined impact amount or more is generated, the control unit 110 may recognize that the dart pin thrown from the user is fouled. However, the present disclosure is not limited thereto.

Meanwhile, the projected display unit 860 may be provided in the lateral surface unit 830 of the target cover unit 800.

When the target cover unit 800 rotates in the first direction and is coupled to the target fixation plate 700, the projected display unit 860 may be provided be disposed at a predetermined location. In this case, when the target cover unit 800 rotates in the first direction, the user may check the location of the projected display unit 860 and fasten at least one bolt.

According to the above-described configuration, the dart target unit 300 and the target cover unit 800 may be provided to be detachable from the front surface of the dart game apparatus 10.

Meanwhile, a component for fixing the dart target unit 300 may be provided on the rear surface of the target cover unit 800. Hereinafter, the target cover unit 800 will be described in more detail through FIGS. 7 and 8.

Figure 7:
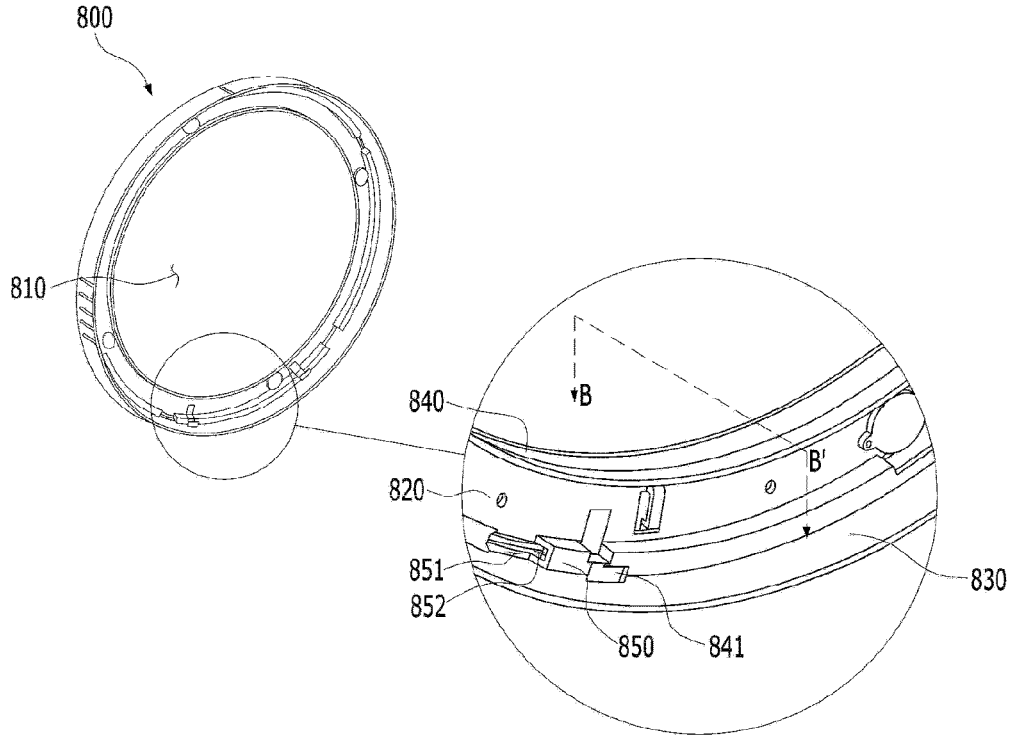
FIG. 7 is a bottom view for describing an example of a target cover unit according to some exemplary embodiments of the present disclosure.
Figure 8:
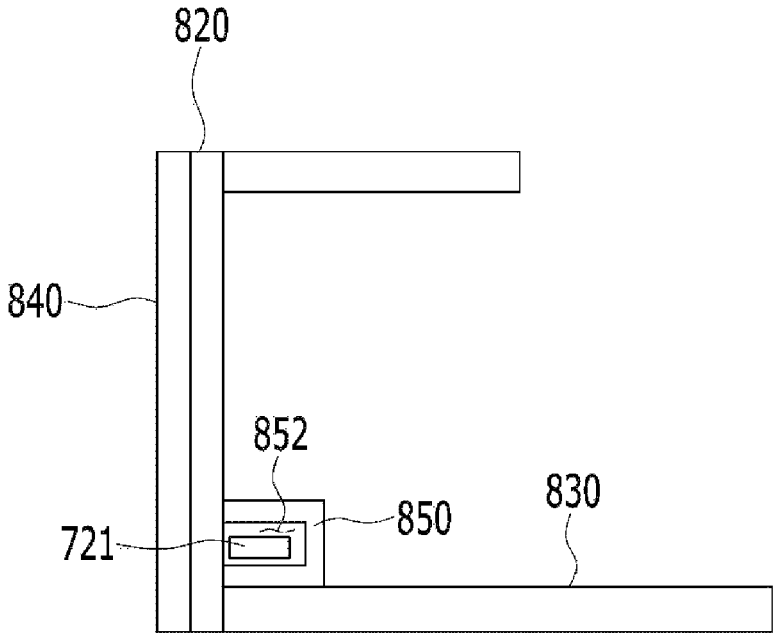
FIG. 8 is a diagram illustrating a cross-sectional view taken along line B'-B' of FIG. 7 in order to describe the target cover unit according to some exemplary embodiments of the present disclosure.

FIG. 7 is a diagram for describing an example of a target cover unit according to some exemplary embodiments of the present disclosure. FIG. 8 is a diagram illustrating a cross-sectional view taken along line B'-B' of FIG. 7 in order to describe the target cover unit according to some exemplary embodiments of the present disclosure.

Referring to FIG. 7, the target cover unit 800 may include an opening unit 810, a front surface unit 820, a lateral surface unit 830, and at least one vibration sensor unit 840, and a projection unit 850. However, the present disclosure is not limited thereto.

The front surface unit 820 may form the front surface of the target cover unit 800. In addition, the front surface unit 820 may be formed to cover at least a part of the dart target unit 300.

The opening unit 810 may be provided in the front surface unit 820. In addition, the opening unit 810 may expose the dart plate 320 to the outside. Accordingly, when the opening unit 810 is provided in the front surface unit 820, at least a part at which the front surface unit 820 covers the dart target unit 300 may be the seating unit 310. However, the present disclosure is not limited thereto.

Meanwhile, the lateral surface unit 830 may form the lateral surface of the target cover unit 800. Further, at least one fastening hole (831 in FIG. 6) for fixing the target cover unit 800 to the target fixation plate 700 may be provided in the lateral surface unit 830.

In the present disclosure, the projection unit 850 may be provided on the rear surface of the front surface unit 820 of the target cover unit 800. In addition, the projection unit 850 may be formed to be projected toward the rear surface of the front surface unit 820.

For example, the projection unit 850 may be formed to be projected from the rear surface of the front surface unit 820 so that an arc shape is formed on an inner peripheral surface of the lateral surface unit 830. Accordingly, the projection unit 850 may be projected toward the suspension protrusion unit (720 in FIG. 6) of the dart target unit 300 by a predetermined distance. However, the present disclosure is not limited thereto.

Meanwhile, at least one dented unit 851 may be provided in the projection unit 850.

Specifically, at least one dented unit 851 may be formed along the inner peripheral surface of the lateral surface unit 830, and formed to be dented toward the front surface unit 820.

For example, at least one dented unit 851 may be dented up to the rear surface of the front surface unit 820 from the projection unit 850. In this case, at least one dented unit 851 may be provided to correspond to the location of at least one suspension protrusion unit (720 in FIG. 6) provided in the target fixation plate 700.

In this case, at least a part of at least one suspension protrusion unit (720 in FIG. 6) may be inserted into at least one dented unit 851.

Specifically, when the target cover unit 800 is seated on the target fixation plate (700 in FIG. 6), the suspension member (721 in FIG. 6) of at least one suspension protrusion unit (720 in FIG. 6) may be inserted into at least one dented unit 851. However, the present disclosure is not limited thereto.

Meanwhile, at least one receiving groove 852 may be provided inside the projection unit 850.

Specifically, at least one receiving groove 852 may be provided inside in at least one area of the projection unit 850 exposed through at least one dented unit 851. In this case, at least one receiving groove 852 may be provided inside the projection unit 850 according to the shape of the arc formed by the projection unit 850. However, the present disclosure is not limited thereto.

Meanwhile, referring to FIG. 8, when the projection unit 850 includes at least one receiving groove 852, the suspension member 721 of at least one suspension protrusion unit 720 may be inserted into at least one receiving groove 852.

Specifically, when the target cover unit 800 is seated on the target fixation plate (700 in FIG. 6), the suspension member 721 may be inserted into at least one dented unit 851. In addition, when the target cover unit 800 rotates in the first direction, the suspension member 721 may be inserted into at least one receiving groove 852. However, the present disclosure is not limited thereto.

In such a case, the target cover unit 800 may be coupled to the target fixation plate 700.

Meanwhile, according to some exemplary embodiments of the present disclosure, when the suspension member 721 of the suspension protrusion unit 720 is inserted into at least one receiving groove 852, the projected display unit 860 may be disposed at a predetermined location.

For example, when the projected display unit 860 is positioned in a 12 o'clock direction, the user may recognize that the suspension member 721 is inserted into at least one receiving groove 852. However, the present disclosure is not limited thereto.

Meanwhile, at least one first power terminal 841 may be provided on the rear surface of the target cover unit 800.

Specifically, referring back to FIG. 7, at least one first power terminal 841 may be provided on the rear surface of the front surface unit 820. In this case, at least one first power terminal 841 may deliver power to at least one vibration sensor unit 840.

For example, when the first power terminal 841 is in contact with at least one second power terminal provided in the dart target unit 300 to be described below, the first power terminal 841 may deliver the power to at least one vibration sensor unit 840. However, the present disclosure is not limited thereto.

According to the above-described structure, the target cover unit 800 may be detachable from the target fixation plate 700 through a motion of the target cover unit 800 which rotates in the first direction or rotates in the second direction opposite to the first direction.

Meanwhile, the target cover unit 800 may receive the power through at least one second power terminal which may be provided in the dart target unit 300. Hereinafter, this will be described below through FIG. 9.

Figure 9:
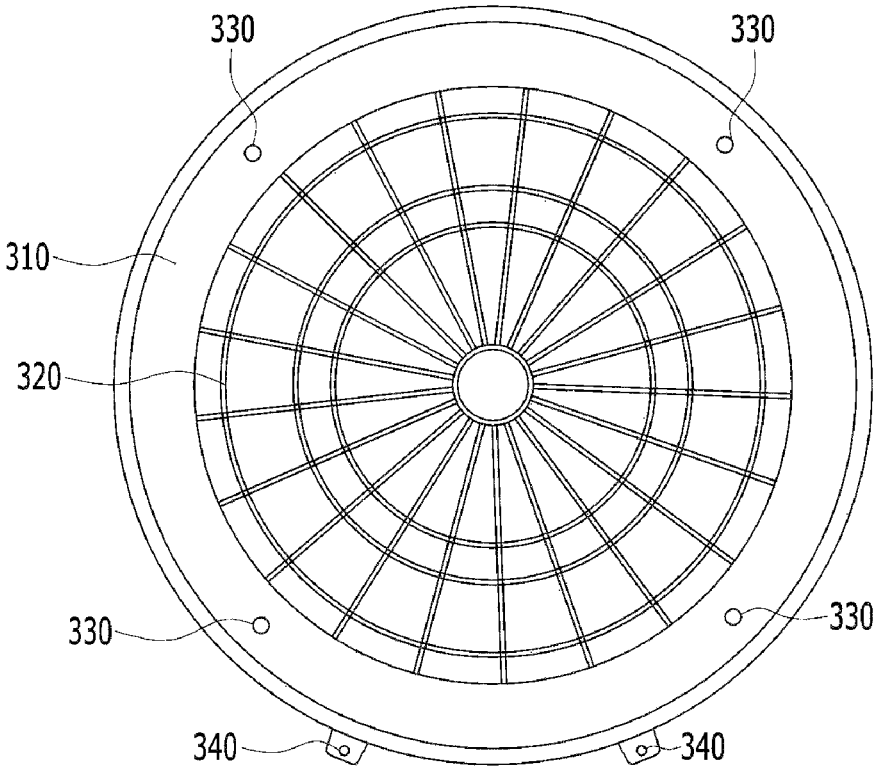
FIG. 9 is a front view for describing an example of the dart target unit according to some exemplary embodiments of the present disclosure.

FIG. 9 is a front view for describing an example of the dart target unit according to some exemplary embodiments of the present disclosure. The contents disclosed in FIG. 6 are referred to for a feature duplicated with the feature described above in relation to FIG. 6 among the features for the contents illustrated in FIG. 9 and here, a description thereof will be omitted.

Referring to FIG. 9, the dart target unit 300 may include at least one second power terminal 340.

Specifically, at least one second power terminal 340 may be provided on the front surface of the seating unit 310 to correspond to a location of at least one first power terminal 841 provided on the rear surface of the target cover unit 800. In this case, at least one second power terminal 340 may be formed to be projected from the seating unit 310 for contacting at least one first power terminal 841. However, the present disclosure is not limited thereto.

In such a case, at least one second power terminal 340 may deliver the power to the vibration sensor unit 840 in contact with at least one first power terminal 841.

Meanwhile, at least one vibration sensor unit 840 that is supplied with the power through a contact of at least one first power terminal 841 and at least one second power terminal 340 may sense the vibration generated by the dart pin thrown from the user. In addition, the control unit 110 may recognize whether the dart pin thrown from the user is fouled by recognizing the vibration amount received from at least one vibration sensor unit 840. For example, when the dart pin thrown from the user hits at least one vibration sensor unit 840 and vibration of a predetermined impact amount or more is generated, the control unit 110 may recognize that the dart pin thrown from the user is fouled. However, the present disclosure is not limited thereto.

Meanwhile, according to some exemplary embodiments of the present disclosure, a location at which at least one second power terminal 340 is provided on the front surface of the seating unit 310 may correspond to a location at which at least one first power terminal 841 is disposed when the target cover unit 800 rotates in the first direction.

In this case, at least one first power terminal 841 and at least one second power terminal 340 may contact each other when a part of the suspension protrusion unit 720 of the target fixation plate 700 is inserted into at least one receiving groove 852. However, the present disclosure is not limited thereto.

Meanwhile, in the present disclosure, the dart target unit 300 may be supplied with the power from a power supply unit provided in the body part 400. In this case, at least one third power terminal may be provided on the front surface of the body part 400 in order to deliver the power supplied from the power supply unit. However, although not limited thereto, a power terminal unit may also deliver the power to the dart target unit 300 through a cable, etc.

According to the above-described configuration, the dart target unit 300 and the target cover unit 800 may be provided with the power while being detachable from the body part 400.

Meanwhile, according to some exemplary embodiments of the present disclosure, it may be indicated that the target cover unit 800 is coupled to the target fixation plate 700 through the projected display unit 860. Hereinafter, an example of a motion of the projected display unit which rotates when the target cover unit 800 rotates in the first direction will be described through FIG. 10.

Figure 10:
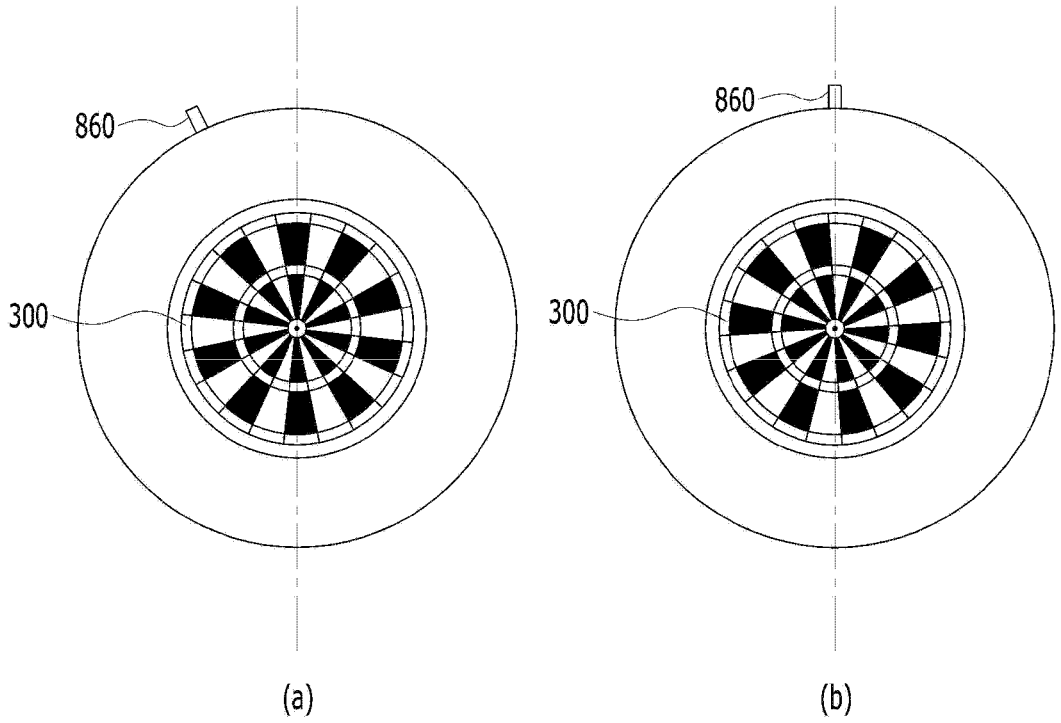
FIG. 10 is a diagram for describing an example of a motion in which when the target cover unit rotates in a first direction, a projected display unit rotates.

FIG. 10 is a diagram for describing an example of a motion in which when the target cover unit rotates in a first direction, a projected display unit rotates.

Referring to FIG. 10, the target cover unit 800 may include the projected display unit 860 on the lateral surface.

Specifically, referring to FIG. 10A, the projected display unit 860 may be positioned in an 11 o'clock direction of the target cover unit 800. In this case, the user may recognize that the target cover unit 800 does not rotate in the first direction. That is, it may be recognized that the suspension member 721 of at least one suspension protrusion unit 720 is not inserted into at least one receiving groove 822 of the target cover unit 800. However, the present disclosure is not limited thereto.

Meanwhile, referring to FIG. 10B, when the target cover unit 800 rotates in the first direction and the suspension member 721 is inserted into at least one receiving groove 822, the projected display unit 860 may be positioned in a 12 o'clock direction. In this case, the user may recognize that the target cover unit 800 is coupled to the target fixation plate 700 and insert at least one bolt into at least one fastening hole 831 provided on the lateral surface of the target cover unit 800. However, the present disclosure is not limited thereto.

As described above, the dart target unit 300 in the present disclosure may be provided to be detachable from the body part 400 through the target cover unit 800.

Specifically, when the dart target unit 300 should be fixed to the front surface of the body part 400, the dart target unit 300 may be seated on the target fixation plate 700. In addition, the target cover unit 800 may be fixed to the target fixation plate 700 while covering at least a part of the front surface of the dart target unit 300. Accordingly, the dart target unit 300 may be fixed to the body part 400.

When the dart target unit 300 needs to be replaced and should be thus separated from the body part 400, the dart target unit 300 may be simply separated from the body part 400 only by releasing the coupling of the target cover unit 800 and the target fixation plate 700. Accordingly, when the dart target unit 300 needs to be replaced due to various reasons, the user may easily separate the dart target unit 300 and the body part 400.

Even when replacing the target cover unit 800 is required, the target cover unit 800 may be easily replaced without the need for touching other components. As replacement of the dart target unit 300 is described and mentioned above, the target cover unit 800 may be easily replaced if only fastening to the target fixation plate 700 is released. In this case, even though the target cover unit 800 is separated, the dart target unit 300 may be temporarily seated on the target fixation plate 700. Accordingly, the user may also easily replace the target cover unit 800 alone.

The description of the presented exemplary embodiments is provided so that those skilled in the art of the present disclosure use or implement the present disclosure. Various modifications of the exemplary embodiments will be apparent to those skilled in the art and general principles defined herein can be applied to other exemplary embodiments without departing from the scope of the present disclosure. Therefore, the present disclosure is not limited to the exemplary embodiments presented herein, but should be interpreted within the widest range which is coherent with the principles and new features presented herein.

What is claimed is:

1. A dart game apparatus comprising:

a body part forming an external appearance of a dart game apparatus;

a target fixation plate provided in one area of a front surface of the body part;

a dart target unit seated on the front surface of the target fixation plate; and a target cover unit formed to cover at least a part of the dart target unit, and fixed and coupled to the target fixation plate;

wherein the dart target unit includes:

a seating unit seated on the front surface of the target fixation plate and having a first diameter, and a dart plate formed to be projected toward the front surface of the seating unit and having a second diameter smaller than the first diameter, further comprising:

at least one guide pin formed to be projected toward the front surface of the body part and guiding locations at which the target fixation plate and the dart target unit are seated on the front surface of the body part, wherein the target fixation plate includes at least one first guide hole provided at a location corresponding to the at least one guide pin, and the seating unit includes at least one second guide hole provided at the location corresponding to the at least one guide pin.

2. The dart game apparatus of claim 1, wherein when the target fixation plate and the seating unit are seated on the front surface of the body part, the at least one guide pin penetrates the at least one first guide hole and the at least one second guide hole.

3. The dart game apparatus of claim 1, wherein the body part includes at least one first guide groove into which the at least one guide pin is inserted so that the at least one guide pin is coupled to the body part.

4. The dart game apparatus of claim 1, wherein the target cover unit includes a front surface unit having an opening unit for exposing the dart plate to outside and covering at least a part of the dart target unit, and a lateral surface unit having at least one fastening hole into which at least one bolt is inserted so that the target cover unit is coupled to the target fixation plate.

5. The dart game apparatus of claim 4, wherein the target fixation plate includes at least one suspension protrusion unit for fixing the target cover unit to an outer peripheral surface, the target cover unit includes a projection unit formed on a rear surface of the front surface unit to be projected toward the rear surface of the front surface unit, and the projection unit includes at least one dented unit formed along an inner peripheral surface of the lateral surface unit and dented toward the front surface unit, and at least one receiving groove provided inside in at least one area of the projection unit exposed through the at least one dented unit.

6. The dart game apparatus of claim 5, wherein the at least one suspension protrusion unit includes a suspension member formed so that at least a part is inserted into the at least one receiving groove, and a connection member formed to extend toward the front surface of the target fixation plate, and connecting the suspension member and the target fixation plate.

7. The dart game apparatus of claim 6, wherein when the target cover unit is seated on the target fixation plate, the suspension member is inserted into the at least one dented unit, and when the target cover unit rotates in a first direction, the suspension member is inserted into the at least one receiving groove.

8. The dart game apparatus of claim 5, wherein the target cover unit includes a projected display unit formed to be projected on an outer peripheral surface, and the projected display unit is disposed at a predetermined location when a part of the suspension protrusion unit is inserted into the at least one receiving groove.

9. The dart game apparatus of claim 3, wherein the target cover unit includes at least one vibration sensor unit disposed on the front surface of the front surface unit, and at least one first power terminal provided on the rear surface of the front surface unit and delivering power to the at least one vibration sensor unit, and the seating unit includes at least one second power terminal delivering power to the vibration sensor unit by being in contact with the at least one first power terminal.

10. The dart game apparatus of claim 9, wherein when a part of the suspension protrusion unit is inserted into the at least one receiving groove, the at least one first power terminal and the at least one second power terminal contact each other.

11. The dart game apparatus of claim 1, wherein the target fixation plate includes an opening unit provided in at least a part thereof, and the body part includes at least one elastic member provided to contact the rear surface of the dart target unit through the opening unit.

12. The dart game apparatus of claim 11, wherein the dart target unit is in close contact with the target cover unit by restoration force of the at least one elastic member.

* * * * *